US010515656B2

(12) United States Patent
Kamano et al.

(10) Patent No.: US 10,515,656 B2
(45) Date of Patent: Dec. 24, 2019

(54) PITCH EXTRACTION DEVICE AND PITCH EXTRACTION METHOD BY ENCODING A BITSTREAM ORGANIZED INTO EQUAL SECTIONS ACCORDING TO BIT VALUES

(71) Applicant: FUJITSU LIMITED, Kawasaki-shi, Kanagawa (JP)

(72) Inventors: Akira Kamano, Kawasaki (JP); Yohei Kishi, Kawasaki (JP); Takeshi Otani, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 183 days.

(21) Appl. No.: 15/719,145

(22) Filed: Sep. 28, 2017

(65) Prior Publication Data

US 2018/0122406 A1 May 3, 2018

(30) Foreign Application Priority Data

Oct. 28, 2016 (JP) ..... 2016-212112

(51) Int. Cl.
*G10L 19/12* (2013.01)
*G10L 19/04* (2013.01)
(Continued)

(52) U.S. Cl.
CPC ..... *G10L 25/90* (2013.01); *G10L 19/002* (2013.01); *G10L 25/06* (2013.01); *G10L 19/018* (2013.01); *G10L 19/04* (2013.01); *G10L 19/12* (2013.01)

(58) Field of Classification Search
USPC ..... 704/219, 206, 501
See application file for complete search history.

(56) References Cited

U.S. PATENT DOCUMENTS 6,377,915 B1 * 4/2002 Sasaki ..... G10L 19/04 704/206
2007/0230805 A1 10/2007 Yamada et al.
(Continued)

FOREIGN PATENT DOCUMENTS

JP 2010-160439 7/2010
JP 2014-507732 3/2014
(Continued)

OTHER PUBLICATIONS

Extended European Search Report dated Mar. 29, 2018 for corresponding European Patent Application No. 17194055.4, 5 pages.
(Continued)

*Primary Examiner* — Farzad Kazeminezhad
(74) *Attorney, Agent, or Firm* — Fujitsu Patent Center

(57) ABSTRACT

A pitch extraction device includes a processor configured to perform a process including: dividing a first bit stream in encoded data into a plurality of sections each having a prescribed section length, the encoded data being obtained by performing entropy encoding on a residual signal calculated by performing linear prediction analysis on a sound signal; allocating a first value or a second value to each of the plurality of sections in the first bit stream in accordance with a bit value in each of the plurality of sections; generating a second bit stream obtained by re-encoding the first bit stream according to the first value and the second value that have been allocated to each of the plurality of sections in the first bit stream; and calculating a fundamental frequency of the sound signal in accordance with an autocorrelation of the second bit stream.

14 Claims, 16 Drawing Sheets

(51) Int. Cl.

| | |
|---|---|
| ***G10L 19/018*** | (2013.01) |
| ***G10L 25/90*** | (2013.01) |
| ***G10L 19/002*** | (2013.01) |
| ***G10L 25/06*** | (2013.01) |

(56) References Cited

U.S. PATENT DOCUMENTS

| | | | | |
|---|---|---|---|---|
| 2012/0221539 | A1 | 8/2012 | Rose et al. | |
| 2012/0221540 | A1 | 8/2012 | Rose et al. | |
| 2013/0096931 | A1* | 4/2013 | Poulsen | G10L 19/018 704/501 |
| 2014/0074460 | A1* | 3/2014 | Shmunk | G10L 19/12 704/219 |

FOREIGN PATENT DOCUMENTS

| | | |
|---|---|---|
| WO | 2006-011197 | 2/2006 |
| WO | 2012116086 | 8/2012 |

OTHER PUBLICATIONS

Liebchen, Tilman et al.,"The MPEG-4 Audio Lossless Coding (ALS) Standard—Technology and Applications", AES Convention 119, Oct. 7-10, 2005, 14 pages, Audio Engineering Society, Convention Paper 6589, 60 East 42nd Street, New York, 10165-2520, USA, XP040507460.

Anantharaman, B. et al.,"Wavelet Based Pitch Extraction in the MPEG Compressed Domain", 2001 IEEE International Conference on Multimedia and Expo, Aug. 22, 2001, pp. 189-192, XP032176933.

Sadaoki Furui, "Digital Speech Processing (Digital Technology Series; 6)", Tokai University Press, published in 1985, Section 4.9 Pitch Extraction (pp. 57-59), and Section 5.4 Extraction of Sound Source Information from Prediction Residual (pp. 69-73) (14 pages total), w/ English translation.

* cited by examiner

301

| DECIMAL VALUE | CODE TO BE ALLOCATED |
|---|---|
| 0 | 1 |
| 1 | 01 |
| 2 | 001 |
| 3 | 0001 |
| ⋮ | ⋮ |
| n | $\underbrace{0\cdots01}_{n\ \text{PIECES}}$ |
| ⋮ | ⋮ |

F I G. 5 A

302

| | |
|---|---|
| ORIGINAL SIGNAL | 1, 2, 5, 3, 1, ··· |
| ENCODED DATA | 01001000001000101··· |

F I G. 5 B

PITCH EXTRACTION DEVICE AND PITCH EXTRACTION METHOD BY ENCODING A BITSTREAM ORGANIZED INTO EQUAL SECTIONS ACCORDING TO BIT VALUES

CROSS-REFERENCE TO RELATED APPLICATION

This application is based upon and claims the benefit of priority of the prior Japanese Patent Application No. 2016-212112, filed on Oct. 28, 2016, the entire contents of which are incorporated herein by reference.

FIELD

The embodiments discussed herein are related to a pitch extraction device and a pitch extraction method.

BACKGROUND

As one example of a method for searching for encoded data of a sound signal or moving image data, a method for searching for encoded data according to search conditions including a pitch (a fundamental frequency) of sound has been proposed. The encoded data of a sound signal is obtained by performing entropy encoding on a residual signal calculated by performing linear prediction analysis on the sound signal. In this type of search method, encoded data is decoded into a sound signal, the pitch of the sound signal is calculated, and it is determined whether the pitch satisfies search conditions (see, for example, Patent Document 1 and Non-Patent Document 1).

Patent Document 1: Japanese Laid-open Patent Publication No. 2010-160439

Non-patent Document 1: SADAOKI FURUI, *Digital Speech Processing* (*Digital Technology Series;* 6), Tokai University Press, Sep. 25, 1985, pp. 57-59 and 69-73

SUMMARY

According to an aspect of the embodiment, a pitch extraction device includes a memory, and a processor coupled to the memory, the processor being configured to perform a process including, dividing a first bit stream in encoded data into a plurality of sections each having a prescribed section length, the encoded data being obtained by performing entropy encoding on a residual signal calculated by performing linear prediction analysis on a sound signal, allocating a first value or a second value to each of the plurality of sections in the first bit stream in accordance with a bit value in each of the plurality of sections, generating a second bit stream obtained by re-encoding the first bit stream according to the first value and the second value that have been allocated to each of the plurality of sections in the first bit stream, calculating an estimation value of a fundamental frequency of the sound signal in accordance with an autocorrelation of the second bit stream, and outputting the estimation value as the fundamental frequency of the sound signal.

The object and advantages of the embodiment will be realized and attained by means of the elements and combinations particularly pointed out in the claims.

It is to be understood that both the foregoing general description and the following detailed description are exemplary and explanatory and are not restrictive of the embodiment.

BRIEF DESCRIPTION OF DRAWINGS

FIG. 5A and FIG. 5B are diagrams explaining unary encoding;

DESCRIPTION OF EMBODIMENTS

Preferred embodiments of the present invention will be explained with reference to accompanying drawings.

In a case in which a large number of pieces of encoded data registered in a database or the like on the network are search targets, in a search method according to search conditions including the pitch of sound, each of the large number of pieces of encoded data is decoded into a sound signal, and a pitch is calculated. Therefore, an operation amount in processing for searching for encoded data of a sound signal of a desired pitch becomes huge, and this results in an increase in search time, an increase in power consumption in a device that performs searching, and the like. Embodiments that enable a fundamental frequency of an encoded sound signal to be efficiently calculated are described below.

<First Embodiment>

Figure 1:
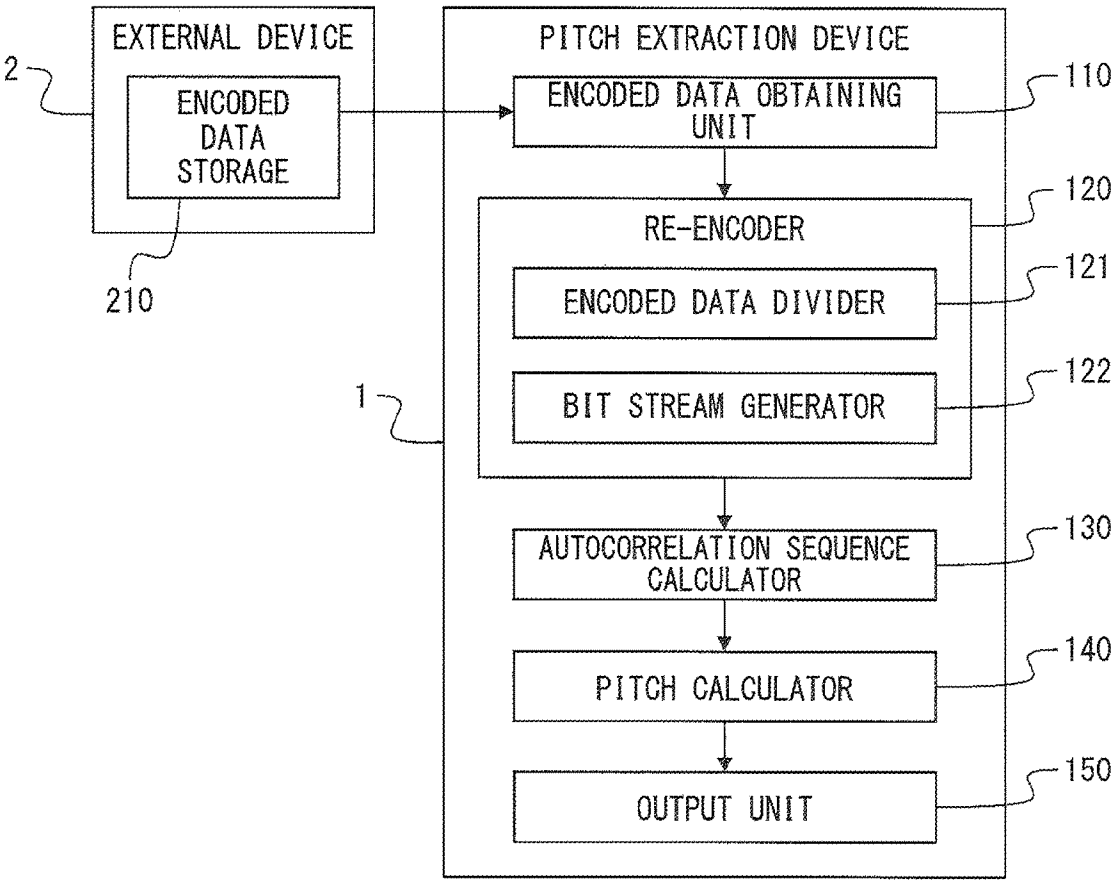
FIG. 1 illustrates a functional configuration of a pitch extraction device according to a first embodiment.

FIG. 1 illustrates a functional configuration of a pitch extraction device according to a first embodiment.

As illustrated in FIG. 1, a pitch extraction device according to this embodiment includes an encoded data obtaining unit 110, a re-encoder 120, an autocorrelation sequence calculator 130, a pitch calculator 140, and an output unit 150.

The encoded data obtaining unit 110 obtains encoded data stored in an encoded data storage 210 of an external device 2. The encoded data obtained by the encoded data obtaining unit 110 is data that has been obtained by performing entropy encoding on a residual signal calculated by performing linear prediction analysis on a sound signal. In the encoded data, "0" and "1" are arranged in an order according to the residual signal. The external device 2 is, for example, an encoder that encodes a sound signal or a storage that stores plural pieces of encoded data.

The re-encoder 120 divides a bit stream (a first bit stream) of the obtained encoded data into plural sections each having a prescribed section length (a prescribed number of digits), and re-encodes the bit stream into a second bit stream in which each of the plural sections in the bit stream is indicated by a first value or a second value. In other words, the re-encoder 120 performs encoding in which each of the plural sections into which a bit stream has been divided is indicated by a first value or a second value so as to generate a second bit stream obtained by re-encoding the first bit stream. The re-encoder 120 according to this embodiment allocates the first value to sections that respectively correspond to pulse positions in a sound signal obtained by decoding the encoded data from among the plural sections, and allocates the second value to the other sections. Assume that a section that corresponds to the pulse position from among the plural sections is a section that includes a prescribed number or more of "0"'s. The first value and the second value in the second bit stream may be any numbers different from each other. In this embodiment, assume that the first value is "1" and that the second value is "0". In a case in which the first value is "1" and the second value is "0", a value of 1 bit is allocated to each of the sections in the first bit stream.

The re-encoder 120 includes an encoded data divider 121 and a bit stream generator 122. The encoded data divider 121 divides a bit stream (a first bit stream) of one frame in encoded data into plural sections each having a prescribed section length. The bit stream generator 122 allocates "1" or "0" to each of the plural sections in the first bit stream, and generates a second bit stream obtained by re-encoding the first bit stream.

The autocorrelation sequence calculator 130 calculates an autocorrelation sequence for the second bit stream.

The pitch calculator 140 calculates an estimation value of a pitch (a fundamental frequency) of a sound signal obtained by decoding the first bit stream in accordance with the calculated autocorrelation sequence.

The output unit 150 outputs various types of information including the calculated estimation value of the pitch. As an example, the output unit 150 displays a character string indicating identification information of encoded data for which an estimation value of a pitch has been calculated, the calculated estimation value of the pitch, and the like.

Figure 2:
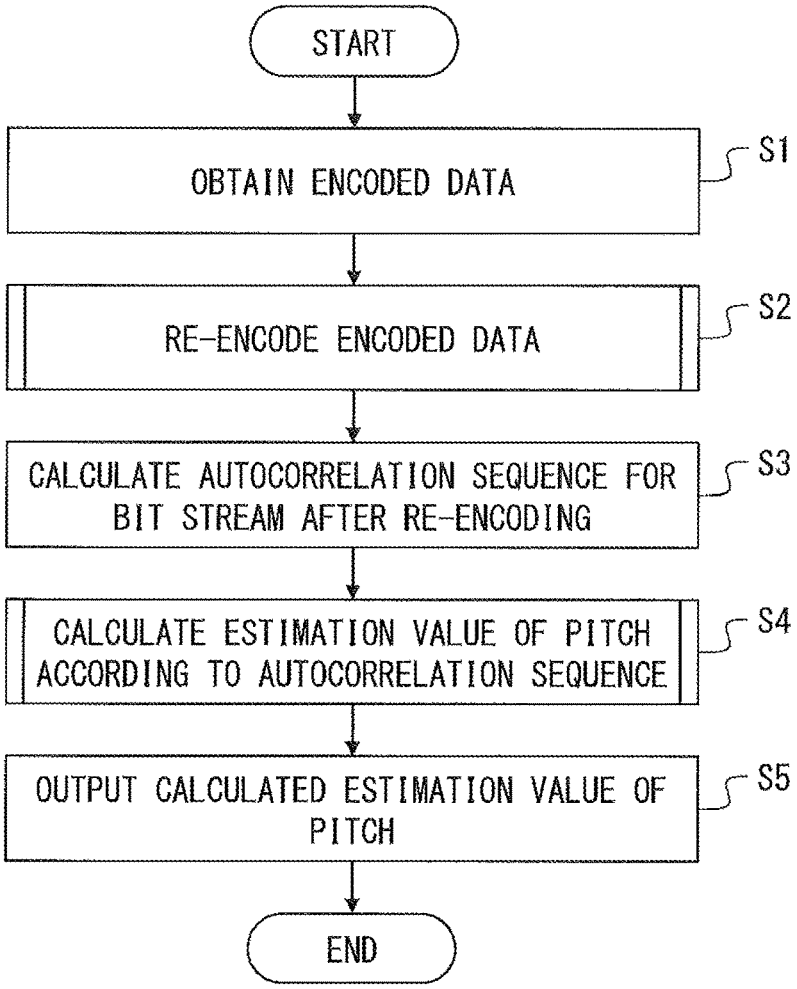
FIG. 2 is a flowchart explaining processing performed by the pitch extraction device according to the first embodiment.

When information that specifies encoded data for which an estimation value of a pitch will be calculated is input to the pitch extraction device 1 according to this embodiment from a not-illustrated input device (or an input unit of the pitch extraction device 1), the pitch extraction device 1 performs the processing illustrated in FIG. 2.

FIG. 2 is a flowchart explaining processing performed by the pitch extraction device according to the first embodiment.

As illustrated in FIG. 2, the pitch extraction device 1 according to this embodiment first obtains encoded data to be processed from the external device 2 (step S1). The process of step S1 is performed by the encoded data obtaining unit 110.

The encoded data obtaining unit 110 obtains, from the external device 2, encoded data that is specified, for example, by an operator (a user) of the pitch extraction device 1 operating a not-illustrated input device or the like.

The pitch extraction device 1 performs a process for re-encoding the obtained encoded data (step S2). The process of step S2 is performed by the re-encoder 120. The re-encoder 120 divides a bit stream (a first bit stream) of one frame in the encoded data into plural sections each having a prescribed section length. The re-encoder 120 allocates "1" to sections that respectively correspond to pulse positions in a sound signal obtained by decoding the first bit stream from among the plural sections in the first bit stream, and allocates "0" to the other sections so as to generate a second bit stream.

The pitch extraction device 1 calculates an autocorrelation sequence for a bit stream after re-encoding (a second bit stream) (step S3). The process of step S3 is performed by the autocorrelation sequence calculator 130. The autocorrelation sequence calculator 130 calculates an autocorrelation sequence Ri for each of N bit streams b(i) {i=0, 1, . . . , N−1} based on the second bit stream, for example, according to expression (1) described below.

$$Ri = \frac{1}{N}\sum_{j=0}^{N-1} b(j)\cdot b((j+i)\%\ N) \tag{1}$$

The symbol "%" in expression (1) is a remainder operator. Namely, the value "(j+i)% N" in expression (1) is a remainder obtained by dividing the value (j+1) by the value N.

The pitch extraction device 1 calculates an estimation value of the pitch of a sound signal obtained by decoding the first bit stream in accordance with the calculated autocorrelation sequences Ri (step S4). The process of step S4 is performed by the pitch calculator 140. The pitch calculator 140 calculates a maximal value (i.e., a local maximum) of the autocorrelation sequences Ri{i=0, 1, . . . , N−1} as the estimation value of the pitch.

The pitch extraction device 1 outputs the calculated estimation value of the pitch (step S5). The process of step S5 is performed by the output unit 150. The output unit 150 displays, for example, a character string that indicates identification information of encoded data for which an estimation value of a pitch has been calculated, the calculated estimation value of the pitch, and the like.

When the output unit 150 finishes the process of step S5, the pitch extraction device 1 finishes processing for calculating an estimation value of the pitch of the specified encoded data.

As described above, the pitch extraction device 1 according to this embodiment re-encodes a bit stream (a first bit stream) of encoded data of a sound signal into a second bit stream instead of decoding the encoded data into the sound signal, and calculates an estimation value of the pitch of the sound signal. The process for re-encoding the encoded data into the second bit stream (step S2) is performed by the re-encoder 120 in the pitch extraction device 1. The re-encoder 120 performs, for example, the processing illustrated in FIG. 3 so as to re-encode a bit stream (the first bit stream) of one frame in the encoded data into the second bit stream.

Figure 3:
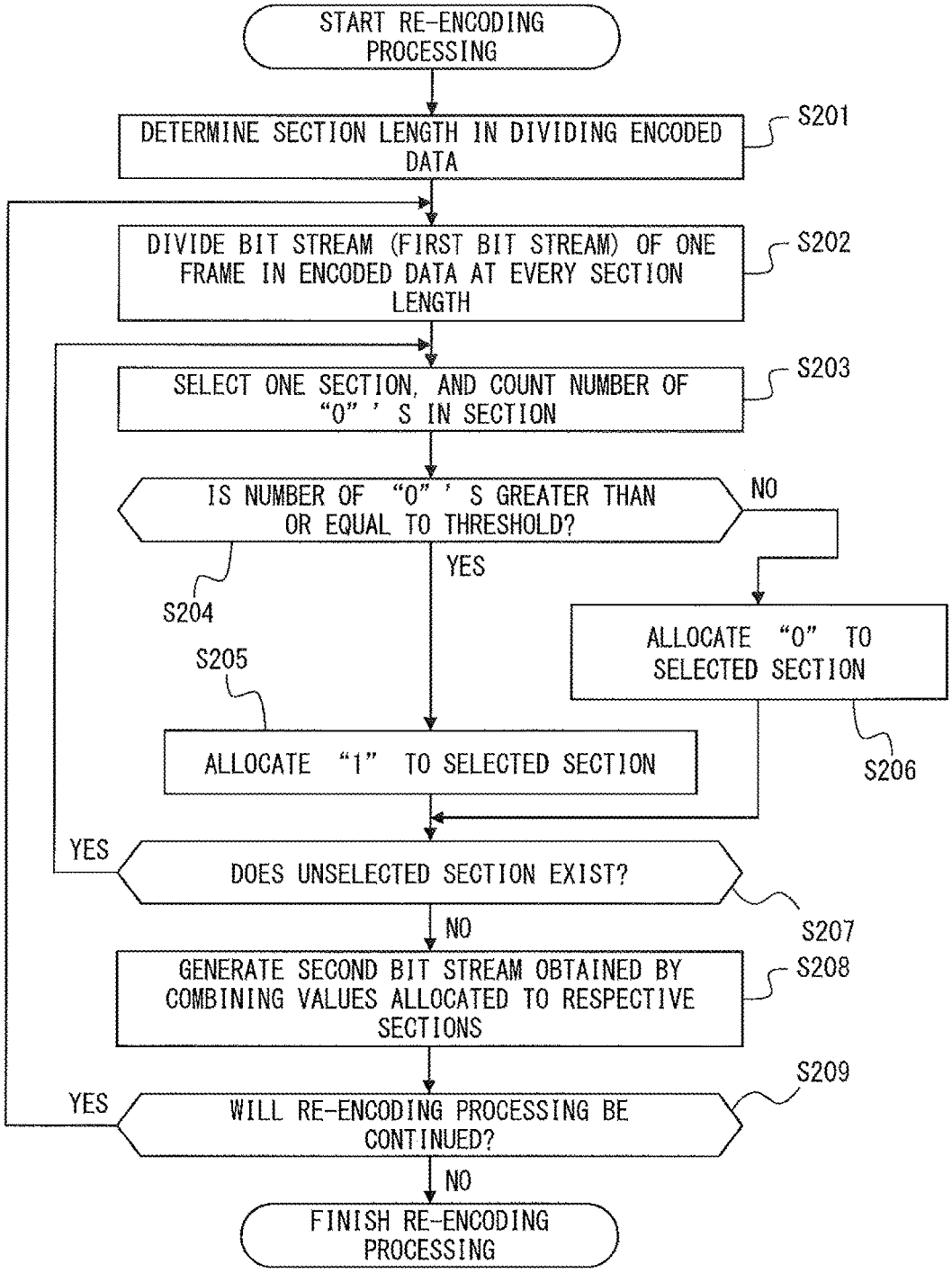
FIG. 3 is a flowchart explaining the content of processing for re-encoding encoded data.

FIG. 3 is a flowchart explaining the content of processing for re-encoding encoded data. FIG. 3 illustrates a flowchart in a case in which the bit values "0" exist consecutively in a section that corresponds to a pulse position in a sound signal obtained by decoding encoded data in a bit stream of the encoded data.

In the processing for re-encoding encoded data, the re-encoder 120 first determines a section length (the number of digits) when dividing a bit stream of the encoded data into plural sections (step S201). The process of step S201 is performed by the encoded data divider 121 in the re-encoder 120. The encoded data divider 121 calculates, as the section length, a value obtained by dividing the data length of encoded data to be processed by the sample length of the original sound.

The re-encoder 120 divides a bit stream (a first bit stream) of one frame in the encoded data at each section length calculated in step S201 (step S202). The process of step S202 is performed by the encoded data divider 121 in the re-encoder 120. The encoded data divider 121 extracts a bit stream of one frame in the encoded data, and divides the bit stream into sections each having the section length (the number of digits) calculated in step S201.

The re-encoder 120 selects one section from the first bit stream, and counts the number of "0"'s in the section (step S203). The process of step S203 is performed by the bit stream generator 122 in the re-encoder 120. The bit stream generator 122 selects one section according to a prescribed selection rule, and counts the number of "0"'s in the section.

The re-encoder 120 determines whether the number of "0"'s in the selected section is greater than or equal to a threshold (step S204). The process of step S204 is performed by the bit stream generator 122 in the re-encoder 120. The threshold used in the determination of step S204 may be, for example, a selection length, or may be a value about 90% of the section length.

When the number of "0"'s in the selected section is greater than or equal to the threshold (step S204; YES), the re-encoder 120 allocates "1" to the selected section (step S205).

When the number of "0"'s in the selected section is smaller than the threshold (step S204; NO), the re-encoder 120 allocates "0" to the selected section (step S206). The processes of steps S205 and S206 are performed by the bit stream generator 122 in the re-encoder 120. In steps S205 and S206, the bit stream generator 122 stores, for example, the position of the selected section in the first bit stream and a value ("1" or "0") that has been allocated to the selected section in association with each other.

When the processes of steps S205 and S206 are finished, the re-encoder 120 determines whether an unselected section exists (step S207). The determination of step S207 is performed by the bit stream generator 122 in the re-encoder 120. When an unselected section exists (step S207; YES), the re-encoder 120 (the bit stream generator 122) repeats the processes of steps S203 to S206.

When all of the sections have been selected (step S207; NO), the re-encoder 120 generates a second bit stream obtained by combining values allocated to the respective sections in the first bit stream (step S208). The process of step S208 is performed by the bit stream generator 122. The bit stream generator 122 generates a second bit stream in which the values allocated to the respective sections in the first bit stream are arranged in order of the alignment of the respective sections in the first bit stream.

When the process of step S208 is finished, the re-encoder 120 determines whether the re-encoding processing will be continued (step S209). The determination of step S209 is performed by either the encoded data divider 121 or the bit stream generator 122. When a frame (a first bit stream) from which a second bit stream has not yet been generated exists in the obtained encoded data and when the first bit stream is re-encoded into the second bit stream, the re-encoder 120 determines that the re-encoding processing will be continued. When the re-encoding processing is continued (step S209; YES), the re-encoder 120 repeats the processes of steps S202 to S208. When the re-encoding processing is finished (step S209; NO), the re-encoder 120 finishes the processing for re-encoding encoded data.

When the processing for re-encoding encoded data is finished, the pitch extraction device 1 performs a process for calculating an autocorrelation sequence for a bit stream (the second bit stream) after re-encoding (step S3). The process for calculating the autocorrelation sequence is performed by the autocorrelation sequence calculator 130. The autocorrelation sequence calculator 130 calculates an autocorrelation sequence Ri for each of N bit streams b(i) {i=0, 1, . . . , N−1} based on the second bit stream according to expression (1) described above.

When the autocorrelation sequence for the second bit stream after re-encoding is calculated, the pitch extraction device 1 performs a process for calculating an estimation value of a pitch according to the autocorrelation sequence (step S4). The process of step S4 is performed by the pitch calculator 140. The pitch calculator 140 performs, for example, the processing illustrated in FIG. 4 so as to calculate an estimation value of the pitch of a sound signal obtained by decoding the first bit stream in the encoded data.

Figure 4:
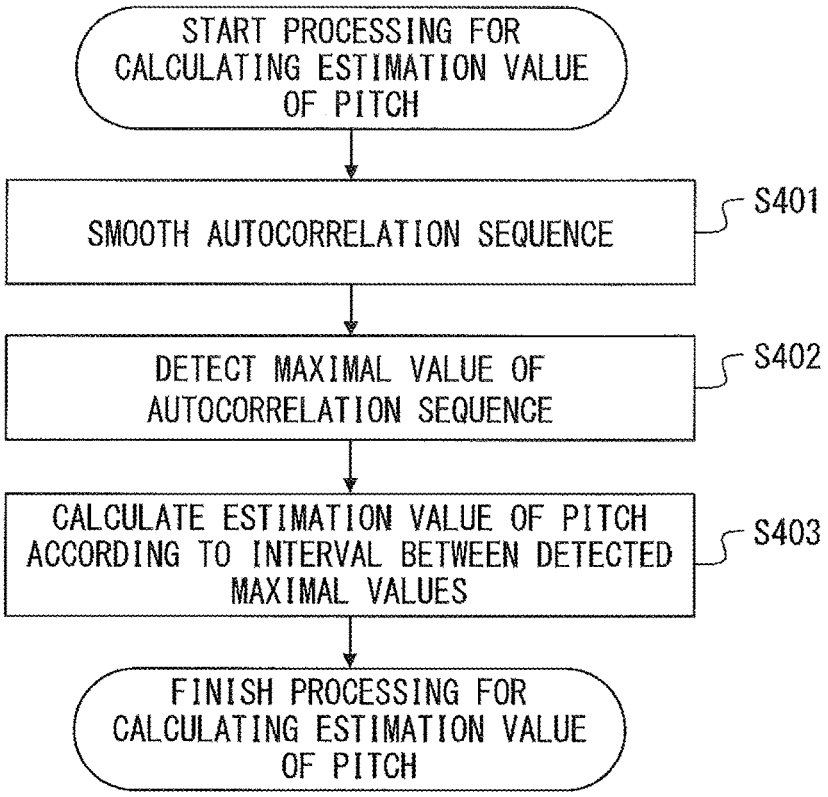
FIG. 4 is a flowchart explaining the content of processing for calculating an estimation value of a pitch.

FIG. 4 is a flowchart explaining the content of the processing for calculating an estimation value of a pitch.

In the processing for calculating an estimation value of a pitch, the pitch calculator 140 first smooths autocorrelation sequences (step S401). In S401, the pitch calculator 140 smooths the autocorrelation sequences Ri calculated in step S3 according to a known smoothing method such as a moving average, a median filter, or a forgetting factor scheme. As an example, the pitch calculator 140 calculates an autocorrelation sequence RSi smoothed by using a moving average according to expression (2) described below.

$$RSi = \frac{1}{T}\sum_{j=0}^{T-1} Rj \tag{2}$$

The value T in expression (2) is an arbitrary value, and it is assumed, for example, that T=3.

The pitch calculator 140 detects a maximal value of the autocorrelation sequences (step S402). In step S402, the pitch calculator 140 uses a mean value of the autocorrelation sequences as the threshold H, and detects an autocorrelation sequence RSk that is greater than or equal to the threshold H and that is greater than adjacent autocorrelation sequences RSk−1 and RSk+1. Here, the autocorrelation sequences RSk−1, RSk, and RSk+1 are respectively autocorrelation sequences in cases in which i=k-1, i=k, and i=k+1. Namely, in step S402, the pitch calculator 140 detects an autocorrelation sequence RSk that satisfies RSk>H, RSk>RSk−1, and RSk>RSk+1. Here, the pitch calculator 140 calculates the threshold H, for example, according to expression (3) described below.

$$H = \frac{1}{N}\sum_{j=0}^{N-1} RSj \tag{3}$$

The pitch calculator 140 calculates an estimation value of a pitch according to an interval between the maximal values detected in step S402 (step S403). In step S403, the pitch calculator 140 sequentially calculates, for example, an interval between adjacent maximal values in the autocorrelation sequences of the second bit stream, and the pitch calculator 140 specifies a frequency that corresponds to a mean value of the intervals to be an estimation value of a pitch. Pitch F0 at the time when the maximal values of adjacent autocorrelation sequences are maximal values RSk and RSm can be calculated according to expression (4) described below.

$$F0 = \frac{Fs}{k-m} \tag{4}$$

In expression (4), Fs is a sampling frequency of encoded data.

When the process of step S403 is finished, the pitch calculator 140 finishes the processing for calculating an estimation value of a pitch.

As described above, the pitch extraction device 1 according to this embodiment re-encodes a first bit stream into a second bit stream, and calculates an estimation value of the pitch of a sound signal obtained by decoding the first bit stream in accordance with an autocorrelation sequence for the second bit stream. Namely, the pitch extraction device 1 according to this embodiment estimates the pitch of a sound signal obtained by decoding a first bit stream in accordance with a second bit stream obtained by re-encoding the first bit stream instead of decoding the first bit stream. In this embodiment, as described above, in the processing for re-encoding the first bit stream into the second bit stream, the first bit stream is divided into plural sections, and the value "1" or "0" is allocated to each of the sections according to the number of "0"'s in the section. In the case of encoded data in which the bit value "0" exists consecutively in sections that respectively correspond to pulse positions in the decoded sound signal, the pitch extraction device 1 allocates "1" to a section in which the number of "0"'s is greater than or equal to a threshold from among the plural sections in the first bit stream, and allocates "0" to the other sections. Therefore, there is a correlation between an interval between adjacent "1"'s in the second bit stream generated by re-encoding and the pitch (a fundamental frequency) of the sound signal obtained by decoding the first bit stream. By calculating an estimation value of the pitch of the sound signal obtained by decoding the first bit stream by using this correlation, an operation amount can be greatly reduced in comparison with a case in which the first bit stream (encoded data) is decoded and the pitch is calculated. Therefore, according to this embodiment, the pitch of encoded data can be calculated in a short time, and power consumption in arithmetic processing can be reduced. Stated another way, according to this embodiment, the pitch of an encoded sound signal can be efficiently calculated (estimated) in terms of both time and power consumption.

Encoded data for which a pitch can be calculated by the pitch extraction device 1 according to this embodiment is, for example, data obtained by performing entropy encoding on a residual signal (an LPC residual signal) calculated by performing linear prediction analysis on a sound signal. The encoded data is not limited to data obtained by performing entropy encoding using a specific encoding scheme, and may be any of the pieces of data that have been encoded according to various types of entropy encoding in which compression efficiency is high in a case in which a probability distribution of the appearance frequency of a signal is a geometric distribution or an exponential distribution. As an example, the encoded data may be data obtained by performing entropy encoding according to one of unary encoding (alpha encoding), gamma encoding, delta encoding, Golomb-Rice encoding, and Huffman encoding. In encoded data obtained by performing entropy encoding according to each of the encoding schemes above, a value having a low appearance frequency is expressed by a bit stream in which "0" or "1" exists consecutively. Accordingly, in encoded data obtained by performing entropy encoding on an LPC residual signal of a sound signal having a high signal-to-noise ratio (for example, 3 dB or more) and a stationary noise component, a section that corresponds to a pulse position in the sound signal is expressed by a bit stream in which "0" or "1" exists consecutively.

A method for calculating an estimation value of a pitch that is performed by the pitch extraction device 1 according to this embodiment is described below in detail by using, as an example, encoded data obtained by performing entropy encoding on an LPC residual signal according to unary encoding.

FIG. 5A and FIG. 5B are diagrams explaining unary encoding. A correspondence table 301 of FIG. 5A illustrates an example of a correspondence relationship between a decimal value and a code to be allocated in unary encoding. A table 302 of FIG. 5B illustrates an example of encoding based on the correspondence table 301.

In unary encoding, as illustrated in the correspondence table 301, a value n expressed as a decimal is converted, for example, into a stream of n+1 bits (digits) obtained by adding "1" to the end of n consecutive "0"'s. As an example, when unary encoding is performed on an original signal for which a decimal value is "1, 2, 5, 3, 1, . . . ", as illustrated in the table 302 of FIG. 5B, the obtained encoded data is "01001000001000101 . . . ". As described above, in unary encoding, as a value to be encoded increases, the number of consecutive "0"'s (the number of digits) increases. In unary encoding, a decimal value n may be converted into a stream of n+1 bits (digits) obtained by adding "0" to the end of n consecutive "1"'s in contrast to the correspondence table 301. In this case, as a value to be encoded increases, the number of consecutive "1"'s increases.

Figure 6:
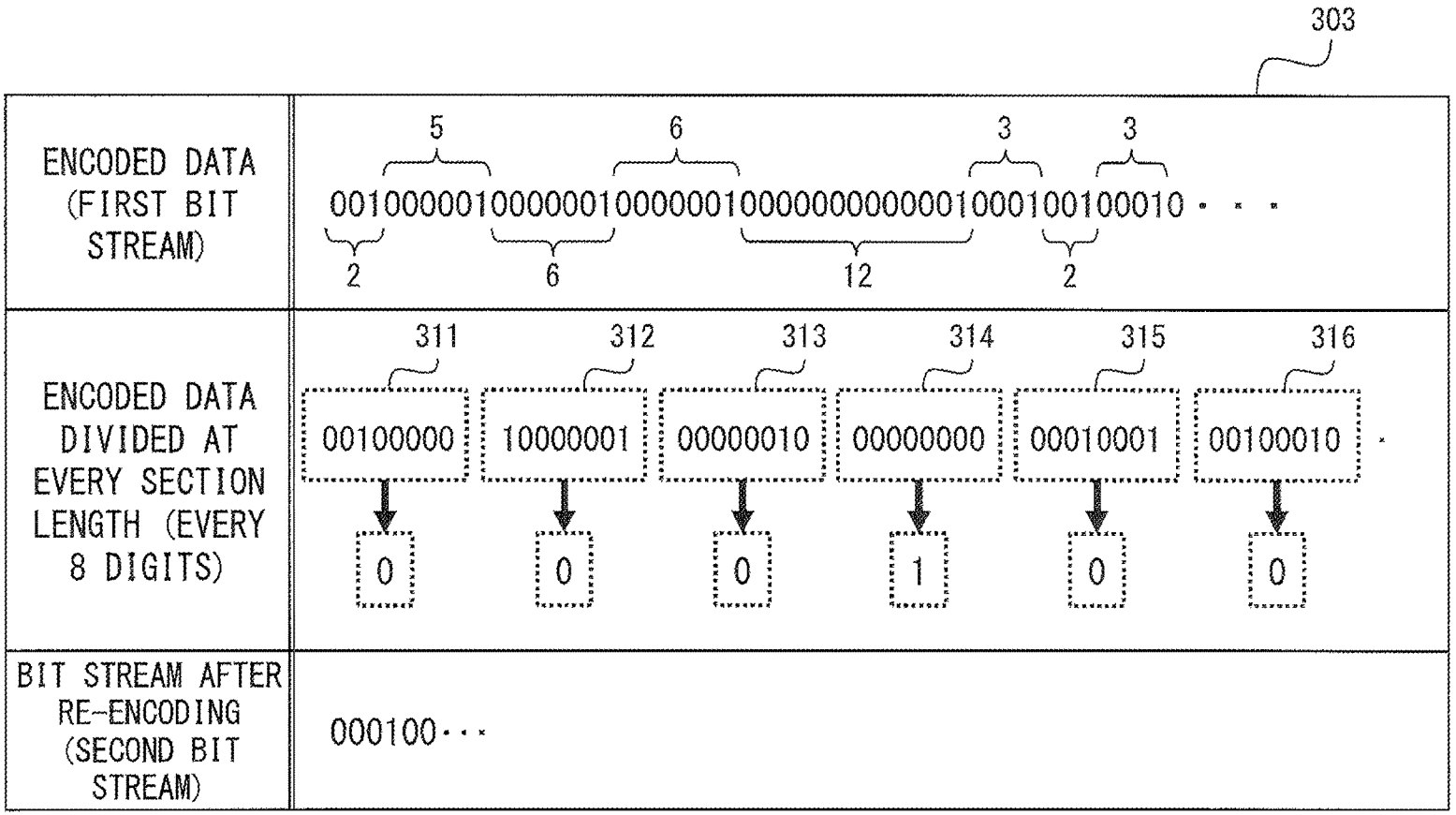
FIG. 6 illustrates an example of encoded data and a bit stream after re-encoding.

FIG. 6 illustrates an example of encoded data and a bit stream after re-encoding.

In an upper row of a table 303 illustrated in FIG. 6, an example of a first bit stream in encoded data obtained by performing encoding according to unary encoding is illustrated. The first bit stream illustrated in the table 303 is a bit stream obtained by encoding the decimal numerical sequence "2, 5, 6, 6, 12, 3, 2, 3, . . . " according to the correspondence table 301 of FIG. 5A.

In the process (step S2) for re-encoding encoded data according to this embodiment, first, the first bit stream is divided into plural sections each having a prescribed section length (a prescribed number of digits) (steps S201 and S202). Assume, for example, that a section length in dividing the first bit stream is 8 digits. The pitch extraction device 1 (the re-encoder 120) divides the first bit stream into sections (bit streams) 311 to 315, 316, . . . of 8 digits, as illustrated in a middle row of the table 303.

Further, the re-encoder 120 allocates "1" or "0" to each of the sections according to the number of "0"'s in each of the sections in the first bit stream (steps S203 to S206). In this embodiment, as described above, "1" is allocated to sections in which the number of "0"'s is greater than or equal to a threshold, and "0" is allocated to the other sections. Here, assume that the threshold is a section length (namely, 8). From among six sections 311 to 316 illustrated in the table 303, "1" is allocated to the fourth section 314 from the head, and "0" is allocated to the other sections 311 to 313, 315, and 316. By doing this, the obtained bit stream (a second bit stream) after re-encoding is "000100 . . . ", as illustrated in a lower row of the table 303. As described above, when encoded data obtained by performing unary encoding is re-encoded by the re-encoder 120, "1" is allocated to a section that corresponds to a portion in which a large number of the same values ("0" in the table 303) exist consecutively in the encoded data, and "0" is allocated to the other sections.

Figure 7:
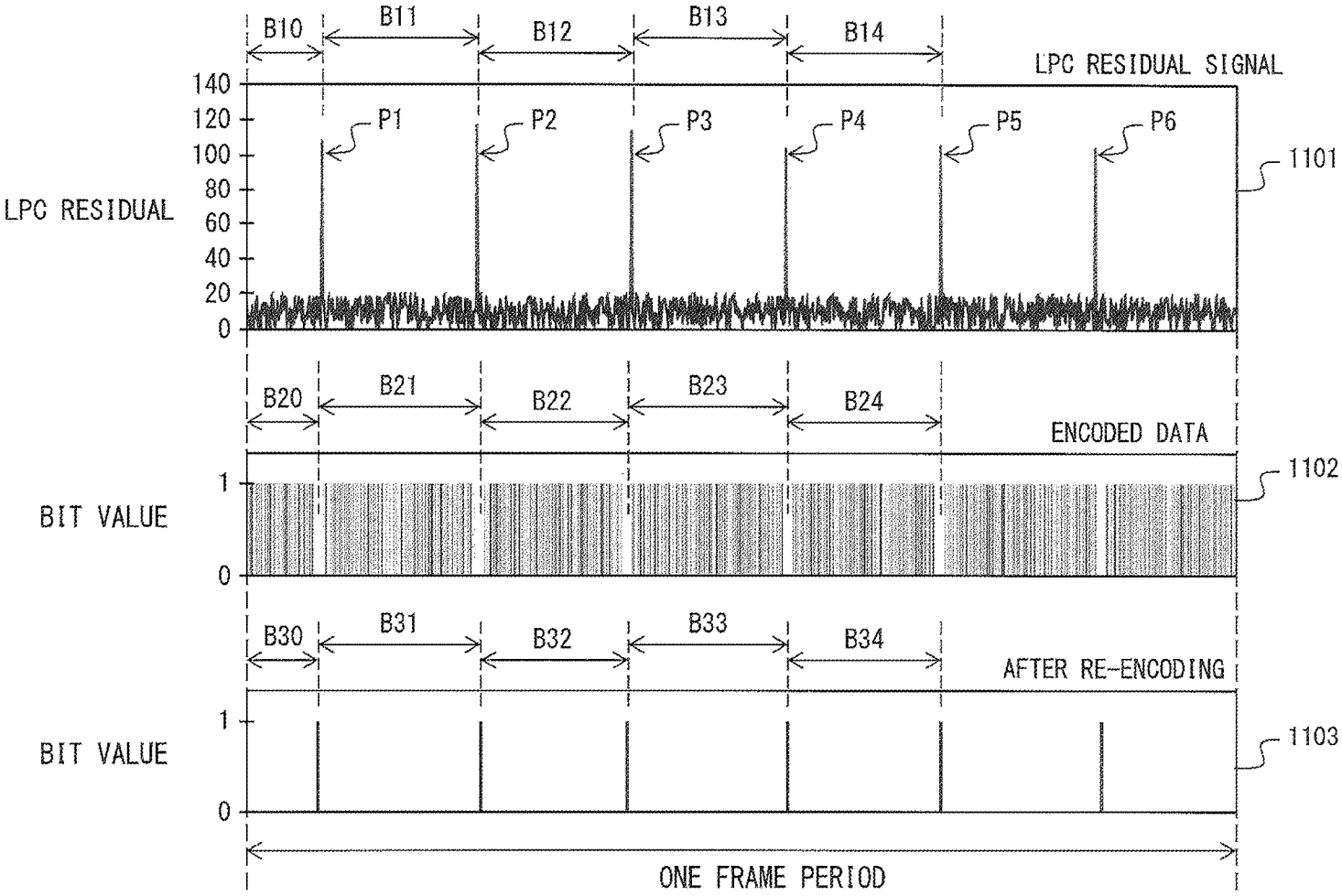
FIG. 7 is a graph explaining a relationship between an LPC residual signal and a bit stream after re-encoding.

FIG. 7 is a graph explaining a relationship between an LPC residual signal and a bit stream after re-encoding.

Among three graphs 1101 to 1103 illustrated in FIG. 7, an upper graph 1101 illustrates an LPC residual signal of one frame period in a pulse signal (a sound signal). In an LPC residual signal for a pulse signal of one frame period, peaks P1 to P6 in which an LPC residual increases appear in a cycle that corresponds to the pitch (a fundamental frequency) of a sound signal. Namely, each of time intervals B11 to B14 between adjacent peaks in the LPC residual signal substantially matches the cycle that corresponds to the pitch.

In a case in which unary encoding is performed on an LPC residual signal of one frame period, an encoder converts a value of an LPC residual at each time in one frame period into a code according to the correspondence table 301 of FIG. 5A. As described above, each of the time intervals B11 to B14 between adjacent peaks in the LPC residual signal substantially matches the cycle that corresponds to the pitch of the sound signal. Stated another way, the time intervals B11 to B14 between adjacent peaks in the LPC residual signal have almost the same value. Further, in an LPC residual signal for a sound signal having a high signal-to-noise ratio and a stationary noise component, the patterns of a temporal change in the LPC residual between adjacent peaks substantially match each other in a broad perspective. As an example, in the graph 1101, the pattern of a temporal change in an LPC residual between the first peak P1 and the second peak P2 and the pattern of a temporal change in an LPC residual between the second peak P2 and the third peak P3 substantially match each other in a broad perspective in that the residual quickly changes between 0 and 20. Accordingly, in encoded data obtained by performing unary encoding on the LPC residual signal, the numbers of digits of bit streams between adjacent peaks substantially match each other. As an example, the number of digits of a bit stream obtained by performing unary encoding on a section from the first peak P1 to the second peak P2 in the LPC residual signal substantially matches the number of digits of a bit stream obtained by performing unary encoding on a section from the second peak P2 to the third peak P3.

Further, codes allocated to values of LPC residuals at peaks P1 to P6 in the LPC residual signal have a very large number of digits in comparison with values of LPC residuals at the other times. Therefore, in encoded data (a first bit stream) obtained by performing unary encoding on the LPC residual signal, sections in which a large number of the bit values "0" exist consecutively are generated at an interval ratio that substantially matches a time interval between peaks in the LPC residual signal, as illustrated in the middle graph 1102 of FIG. 7. The middle graph 1102 of FIG. 7 illustrates a polygonal line that connects bit values in adjacent digits in the encoded data (the first bit stream) by using a straight line. Stated another way, in the graph 1102, a value frequently changes in a section where vertical lines are dense, and the same value (in this embodiment, "0") exists consecutively in a section where vertical lines are sparse. In the graph 1102 of FIG. 7, a horizontal axis (namely, a data length (the number of digits) of encoded data of one frame period) is coincident with one frame period in the graph 1101 of FIG. 7. Accordingly, the section where vertical lines are sparse in the graph 1102 appears in positions that respectively correspond to peaks P1 to P6 in the LPC residual signal.

Stated another way, in a case in which unary encoding is performed on an LPC residual signal for a pulse signal (a sound signal), the ratio B21:B22:B23:B24 of the number of digits indicating an interval between adjacent peaks in encoded data is about 1:1:1:1. Further, in a case in which unary encoding is performed, the ratio B20/B21 of the number of digits in the encoded data substantially matches the ratio B10/B11 of a time interval in the LPC residual signal. The value B20 is the number of digits of a bit stream from the head to the first peak in one frame period in the encoded data, and the value B10 is a time interval from the head to the first peak P1 in one frame period in the LPC residual signal.

In addition, in re-encoding according to this embodiment, as described above, "1" is allocated to sections in which the same value is greater than or equal to a threshold from among plural sections in the first bit stream, and "0" is allocated to the other sections. Accordingly, when a bit stream (a first bit stream) of one frame in the encoded data is re-encoded according to re-encoding according to this embodiment, a bit value in a bit stream (a second bit stream) after re-encoding is as illustrated in the lower graph 1103 of FIG. 7. In the second bit stream, only sections in which "0" exists consecutively in the first bit stream have "1", and the other sections have "0". The graph 1103 of FIG. 7 illustrates a polygonal line that connects bit values at adjacent digits in the second bit stream by using a straight line. In the graph 1103 of FIG. 7, a horizontal axis (namely, a data length (the number of digits) of the second bit stream) is coincident with one frame period in the graph 1101 or 1102 of FIG. 7.

In a case in which the first bit stream is re-encoded into the second bit stream by performing re-encoding according to this embodiment, the ratio B31:B32:B33:B34 of the number of sections indicating an interval between adjacent "1"'s in the second bit stream is about 1:1:1:1. Further, in a case in which the first bit stream is re-encoded into the second bit stream by performing re-encoding according to this embodiment, the ratio B30/B31 of the number of digits in the second bit stream substantially matches the ratio B20/B21 of the number of digits in the first bit stream. Here, the value B30 is the number of digits from the head to the first peak in one frame period in the second bit stream.

Namely, the respective positions of digits at which the value "1" indicating a pulse position appears in the second bit stream for the LPC residual signal of one frame period substantially match times at which peaks P1 to P6 appear in the LPC residual signal. Accordingly, the pitch of a sound signal (a pulse signal) obtained by decoding the encoded data (the first bit stream) can be estimated according to the data length (the number of digits) of the second bit stream and the positions of digits at which the value "1" indicating the pulse position appears.

The ratio B21:B22:B23:B24 of the number of digits indicating an interval between adjacent peaks in the encoded data is not 1:1:1:1 in some cases. Similarly, the ratio B31:B32:B33:B34 of the number of sections indicating an interval between adjacent "1"'s in the second bit stream is not 1:1:1:1 in some cases. Therefore, in this embodiment, as illustrated in FIG. 2 and FIG. 4, an estimation value of the pitch of a sound signal obtained by decoding the encoded data is calculated according to an autocorrelation sequence for the second bit stream. An inventor of the present invention has compared an estimation value of a pitch calculated in the processing according to this embodiment with a pitch calculated from a sound signal obtained by decoding encoded data, by using several pieces of encoded data of sound sources (sound signals), and has confirmed that an error is 25 Hz or less. Thus, according to this embodiment, an operation amount can be greatly reduced, and the accuracy of the extraction of a pitch can be suppressed from being reduced.

An encoding scheme for performing entropy encoding of an LPC residual signal, as described above, is not limited to unary encoding, and any scheme in which a peak value (a value having a low appearance frequency) that corresponds to a pulse position in the LPC residual signal is expressed by a bit stream including consecutive "0"'s or "1"'s can be employed. In other words, an encoding scheme for performing entropy encoding on an LPC residual signal may be any encoding scheme in which a compression efficiency increases in a case in which a ratio distribution of the appearance frequency of a signal is a geometric distribution or an exponential distribution. In lossless encoding such as MPEG-4 audio lossless coding (MPEG-ALS) or free lossless audio codec (FLAC), an LPC residual signal is assumed to have a geometric distribution property, and unary encoding or Golomb-Rice encoding is employed as an encoding scheme of entropy encoding. Accordingly, encoded data may be data obtained by performing entropy encoding on an LPC residual signal according to Golomb-Rice encoding. Further, the encoded data may be, for example, data obtained by performing entropy encoding on an LPC residual signal according to any of gamma encoding, delta encoding, or Huffman encoding.

The flowchart of FIG. 3 is an example of the processing for re-encoding encoded data (a first bit stream) into a second bit stream. The processing for re-encoding the encoded data (the first bit stream) into the second bit stream is not limited to the processing of FIG. 3, and can be appropriately changed. As an example, the allocation of "0" and "1" in the encoded data and the allocation of "0" and "1" in the second bit stream may be inverse to the allocation in the flowchart of FIG. 3. As another example, the processing for allocating "1" or "0" to each of the sections in the first bit stream may be processing for performing a NOT operation on a value obtained by performing an OR operation on all of the bit values in a section and for allocating a value obtained by performing the NOT operation to the section. The processing for allocating "1" or "0" to each of the sections in the first bit stream may be, for example, processing for allocating a value obtained by performing an AND operation on all of the bit values in a section to the section.

The autocorrelation sequence for the second bit stream does not always need to be calculated according to a calculation method using expression (1), and may be calculated according to another calculation method. As an example, an AND of bit values at the same digit in the second bit stream and a third bit stream obtained by shifting the second bit stream may be calculated, and the autocorrelation sequence may be calculated according to the number of digits in the second bit stream and the number of digits at which the AND becomes "1". As another example, a Hamming distance between the second bit stream and the third bit stream obtained by shifting the second bit stream may be calculated, and the calculated Hamming distance may be specified as the autocorrelation sequence. Stated another way, bit values at the same digit in the second bit stream and the third bit stream may be compared with each other, and the autocorrelation sequence may be calculated according to the number of digits in the second bit stream and the number of digits at which bit values are different from each other.

Further, the flowchart of FIG. 4 is an example of the processing for calculating an estimation value of a pitch according to the autocorrelation sequence. The processing for calculating the estimation value of the pitch is not limited to the processing of FIG. 4, and may be appropriately changed. As an example, the estimation value of the pitch may be calculated according to the position of a maximal value that exceeds a prescribed threshold in the autocorrelation sequence.

<Second Embodiment>

In this embodiment, another example of the processing for re-encoding encoded data is described. A pitch extraction device 1 according to this embodiment includes an encoded data obtaining unit 110, a re-encoder 120, an autocorrelation sequence calculator 130, a pitch calculator 140, and an output unit 150, as illustrated in FIG. 1. From among these functional blocks in the pitch extraction device 1 according to this embodiment, the encoded data obtaining unit 110, the autocorrelation sequence calculator 130, the pitch calculator 140, and the output unit 150 have the respective functions described in the first embodiment.

Figure 8:
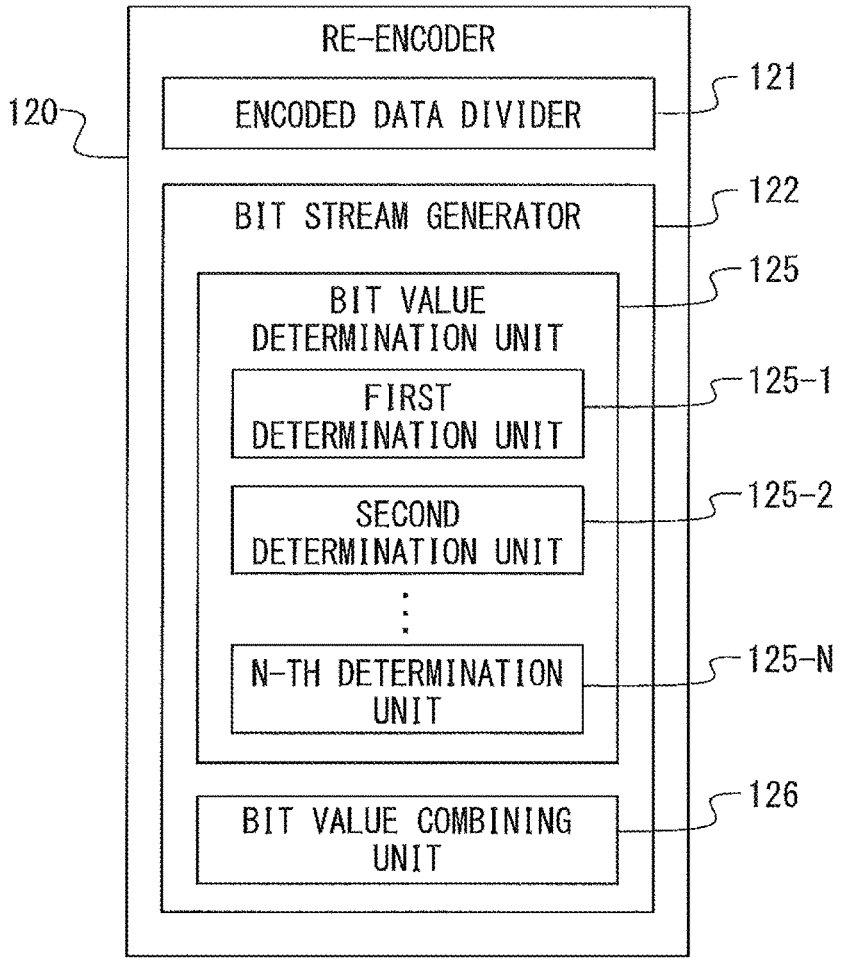
FIG. 8 illustrates a functional configuration of a re-encoder in a pitch extraction device according to a second embodiment.

FIG. 8 illustrates a functional configuration of a re-encoder in the pitch extraction device according to the second embodiment.

As illustrated in FIG. 8, the re-encoder 120 according to this embodiment includes an encoded data divider 121 and a bit stream generator 122. The encoded data divider 121 divides a bits stream (a first bit stream) of one frame in encoded data into plural sections each having a prescribed section length (a prescribed number of digits). The bit stream generator 122 allocates "1" or "0" to each of the plural sections in the first bit stream so as to generate a second bit stream obtained by re-encoding the first bit stream. The bit stream generator 122 includes a bit value determination unit 125 and a bit value combining unit 126.

The bit value determination unit 125 determines the bit value "1" or "0" to be allocated to each of the plural sections in the first bit stream. The bit value determination unit 125 includes N determination units (a first determination unit 125-1, a second determination unit 125-2, . . . , and an N-th determination unit 125-N), and the bit value determination unit 125 performs a process for allocating "1" or "0" in parallel on the N sections. The number of determination units 125-1, 125-2, . . . , and 125-N in the bit value determination unit 125 maybe dynamically changed according to the number of sections obtained by dividing the first bit stream into plural sections, or may be fixed to a prescribed number.

The bit value combining unit 126 generates a second bit stream obtained by combining bit values determined by the N determination units in the bit value determination unit 125 in order of the alignment of sections in the first bit stream.

The pitch extraction device 1 according to this embodiment performs the processes of steps S1 to S5 illustrated in FIG. 2. However, the pitch extraction device 1 according to this embodiment performs the processing illustrated in FIG. 9 as the process of step S2 for re-encoding encoded data.

Figure 9:
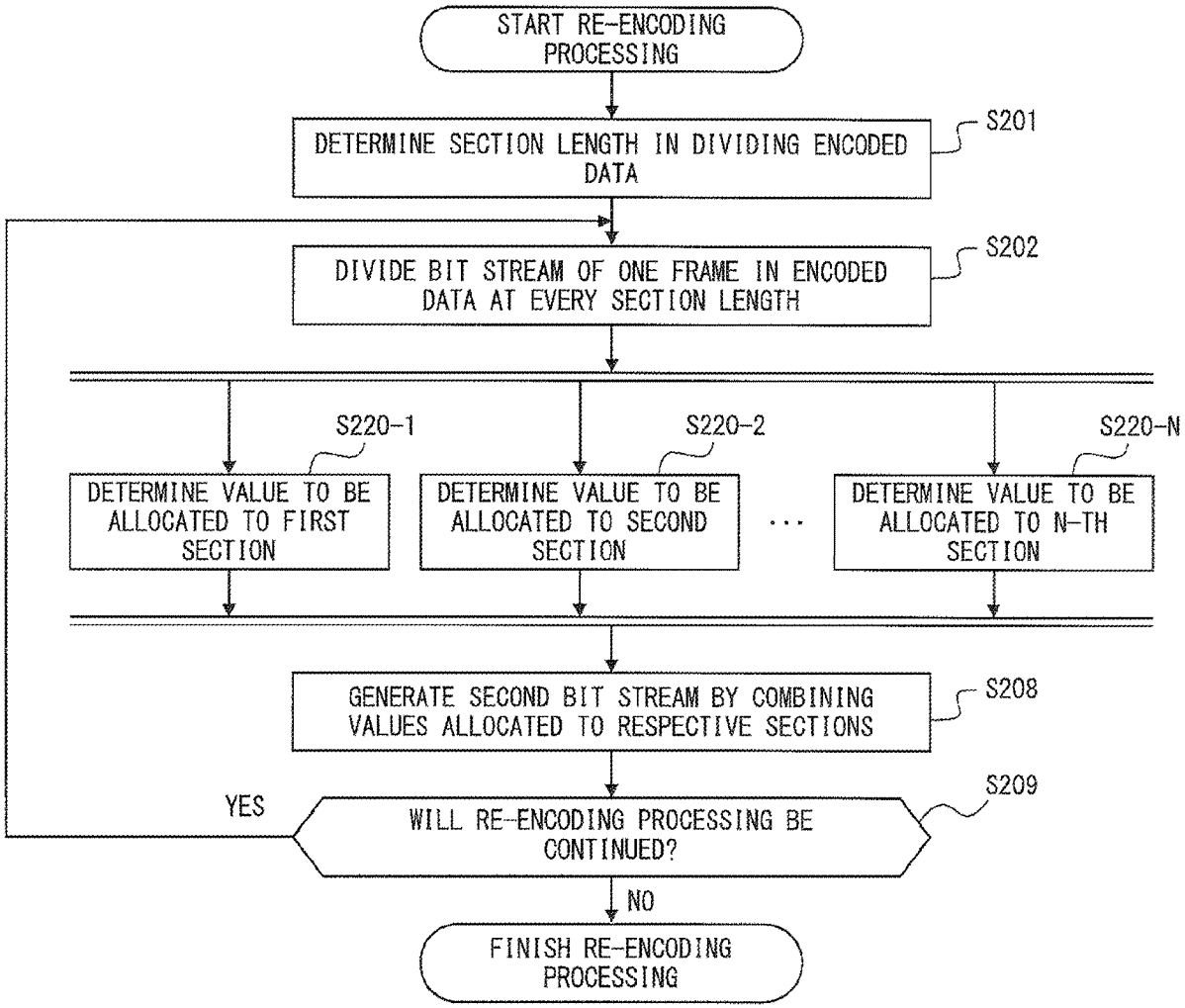
FIG. 9 is a flowchart explaining the content of processing for re-encoding encoded data according to the second embodiment.

FIG. 9 is a flowchart explaining the content of processing for re-encoding encoded data according to the second embodiment.

The processing illustrated in FIG. 9 for re-encoding encoded data is performed by the re-encoder 120 in the pitch extraction device 1. The re-encoder 120 first determines a section length (the number of digits) in dividing a bit stream (a first bit stream) of encoded data into plural sections (step S201). The process of step S201 is performed by the encoded data divider 121 of the re-encoder 120. The encoded data divider 121 calculates, as the section length, a value obtained by dividing the data length of encoded data to be processed by a sample length of original sound.

The re-encoder 120 divides a bit stream (the first bit stream) of one frame in the encoded data at each section length calculated in step S201 (step S202). The process of step S202 is performed by the encoded data divider 121 in the re-encoder 120. The encoded data divider 121 extracts a bit stream of one frame in the encoded data, and divides the bit stream into N sections each having the section length (the number of digits) calculated in step S201.

The re-encoder 120 performs a process for determining a bit value to be allocated to each of the N sections in the first bit stream in parallel (steps S220-1, S220-2, . . . , and S220-N). Here, a pair of double lines illustrated in FIG. 9 indicate that plural processes (steps S202-1, S202-2, . . . , and S202-N) that are sandwiched between the pair of double lines are performed in parallel. The process of step S201-*n* (n=1, 2, . . . , N) is performed by the n-th determination unit 125-*n* in the bit value determination unit 125. The n-th determination unit 125-*n* performs the processes of steps S203 to S206 in FIG. 3 as the process of step S201-*n*. The n-th determination unit 125-*n* performs a process for counting the number of "0"'s in the n-th section as the process of step S203. In addition, the n-th determination unit 125-*n* determines whether the number of "0"'s in the n-th section is greater than or equal to a threshold, as the determination process of step S204. Further, the n-th determination unit 125-*n* performs a process for allocating "1" to the n-th section and a process for allocating "0" to the n-th section as the processes of steps S205 and S206, respectively.

When the parallel processes of steps S220-1, S220-2, . . . , and S220-N are finished, the re-encoder 120 combines the values allocated to the respective sections so as to generate a second bit stream (step S208). The process of step S208 is performed by the bit value combining unit 126. The bit value combining unit 126 combines the values ("1" or "0") allocated to the respective sections in order of the alignment of the respective sections in the first bit stream so as to generate a second bit stream.

When the process of step S208 is finished, the re-encoder 120 determines whether the re-encoding processing will be continued (step S209). The determination of step S209 is performed by either the encoded data divider 121 or the bit stream generator 122. When the obtained encoded data includes a frame (a first bit stream) from which a second bit stream has not yet been generated and when the first bit stream is re-encoded into the second bit stream, the re-encoder 120 determines that the re-encoding processing will be continued. When the re-encoding processing is continued (step S209; YES), the re-encoder 120 repeats the processes of steps S202 to S208. When the re-encoding processing is finished (step S209; NO), the re-encoder 120 finishes the processing for re-encoding encoded data.

When the processing for re-encoding encoded data is finished, the pitch extraction device 1 performs the processes of S3 to S5 in FIG. 2. The pitch extraction device 1 according to this embodiment performs the respective processes described in the first embodiment as the processes of steps S3 to S5.

As described above, in the processing for re-encoding encoded data according to this embodiment, a process for allocating "1" or "0" is performed in parallel on plural sections in the first bit stream. Therefore, the processing time of the re-encoding processing can be further reduced in comparison with a case in which the process for allocating "1" or "0" is sequentially performed on each of the sections, as in the first embodiment.

The number N of the determination units 125-1, 125-2, . . . , and 125-N in the bit value determination unit 125 according to this embodiment may be fixed. In a case in which the number N of the determination units 125-1, 125-2, . . . , and 125-N is fixed, a process for allocating a bit value to M (>N) sections into which the first bit stream is divided is performed in two or more steps. As an example, when 2N>M>N, the bit value determination unit 125 performs a process for allocating "1" or "0" to each of the N sections and a process for allocating "1" or "0" to M-N sections.

<Third Embodiment>

Figure 10:
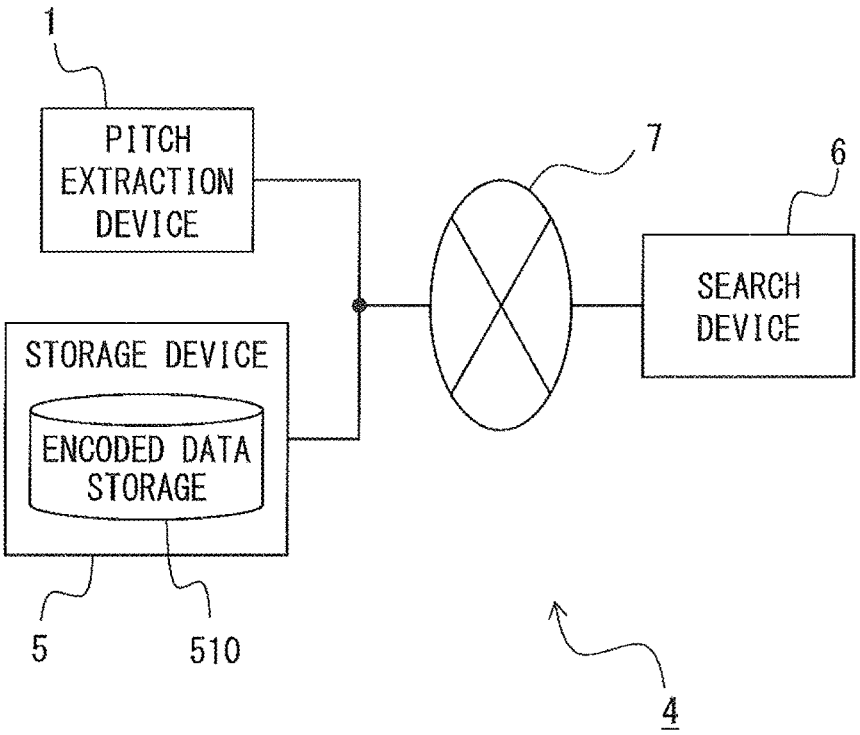
FIG. 10 illustrates a system configuration of a search system according to a third embodiment.

FIG. 10 illustrates a system configuration of a search system according to a third embodiment.

As illustrated in FIG. 10, a search system 4 according to this embodiment includes a pitch extraction device 1, a storage device 5, and a search device 6.

The pitch extraction device 1 is the device described in the first embodiment or the second embodiment. The pitch extraction device 1 obtains encoded data stored in an encoded data storage 510 in the storage device 5, and calculates an estimation value of the pitch of a sound signal obtained by decoding the encoded data. The encoded data stored in the storage device 5 is, for example, data obtained by performing entropy encoding on an LPC residual signal indicating music, sound included in a moving image, or the like. In addition, the encoded data stored in the storage device 5 may be, for example, data obtained by performing entropy encoding on an LPC residual signal for a sound signal obtained from a camera used to perform fixed point observation or a sound collection device.

The search device 6 searches for encoded data stored in the encoded data storage 510 of the storage device 5, and obtains encoded data of a desired pitch. The search device 6 in the search system 4 according to this embodiment transmits search conditions such as pitch information to the pitch extraction device 1, and causes the pitch extraction device 1 to search for encoded data. The pitch extraction device 1 returns, to the search device 6, a search result based on the search conditions received from the search device 6 or encoded data that satisfies the search conditions.

The search system 4 according to this embodiment is applied, for example, to a distribution system that distributes encoded data, such as music or a moving image, that has been stored in the encoded data storage 510 of the storage device 5 via a network 7 such as the internet. The search system 4 is also applied, for example, to the checking of the presence/absence of abnormality in a fixed point observation such as a guard. The search device 6 accesses the pitch extraction device 1 via the network 7, and transmits the search conditions including the pitch information to the pitch extraction device 1, for example, in order to obtain encoded data of a sound signal of a desired pitch from among pieces of encoded data stored in the storage device 5.

Figure 11:
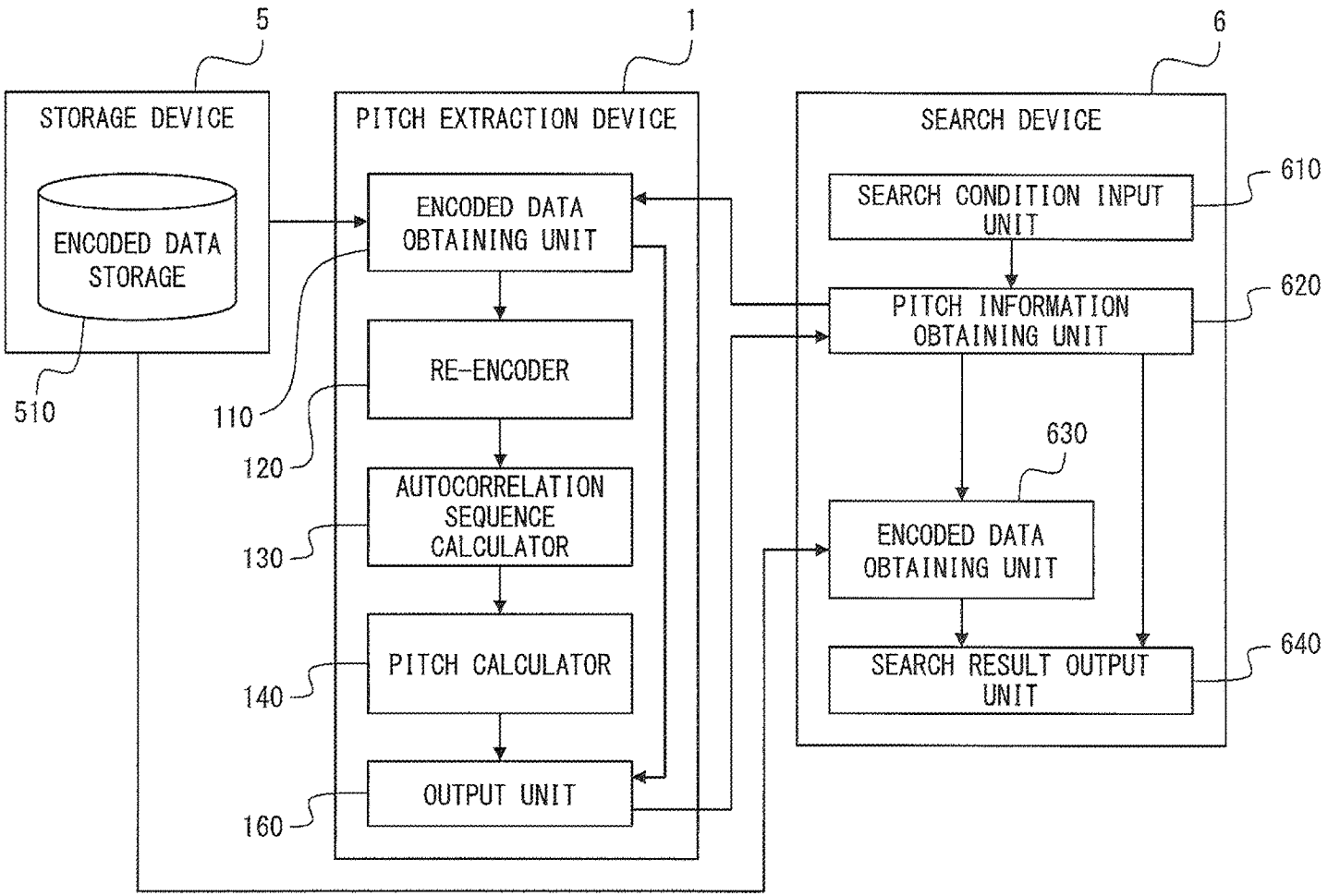
FIG. 11 illustrates a functional configuration of the search system according to the third embodiment.

FIG. 11 illustrates a functional configuration of the search system according to the third embodiment.

As illustrated in FIG. 11, the pitch extraction device 1 in the search system 4 according to this embodiment includes an encoded data obtaining unit 110, a re-encoder 120, an autocorrelation sequence calculator 130, a pitch calculator 140, and an output unit 160.

Upon receipt of the search conditions (an extraction instruction) including the pitch information from the search device 6, the encoded data obtaining unit 110 in the pitch extraction device 1 according to this embodiment sequentially obtains encoded data stored in the encoded data storage 501 of the storage device 5. In addition, the encoded data obtaining unit 110 according to this embodiment transmits the search conditions received from the search device 6 to the output unit 160.

The re-encoder 120 in the pitch extraction device 1 according to this embodiment includes, for example, the encoded data divider 121 and the bit stream generator 122 described in the first embodiment (see FIG. 2). The re-encoder 120 in the pitch extraction device 1 according to this embodiment may include, for example, the encoded data divider 121, the bit value generator 125, and the bit value combining unit 126 that have been described in the second embodiment (see FIG. 8).

The autocorrelation sequence calculator 130 and the pitch calculator 140 in the pitch extraction device 1 according to this embodiment have the respective functions described in the first embodiment.

The output unit 160 in the pitch extraction device 1 according to this embodiment outputs, to the search device 6, a search result that includes an estimation value that satisfies the search conditions from among the estimation values of the pitches calculated by the pitch calculator 140 and information such as the file name of encoded data for which the estimation value has been calculated.

In addition, the search device 6 in the search system 4 according to this embodiment includes a search condition input unit 610, a pitch information obtaining unit 620, an encoded data obtaining unit 630, and a search result output unit 640, as illustrated in FIG. 11.

The search condition input unit 610 inputs search conditions for encoded data stored in the encoded data storage 510 of the storage device 5. The search conditions include the pitch (a fundamental frequency) of a sound signal. The pitch of the sound signal included in the search conditions is not limited to a numerical value or a range of numerical values that indicates the pitch, and the pitch can be specified by the type of a sound source, such as gender or the name of a musical instrument. The search conditions may include, for example, the date of the generation of encoded data (a sound signal).

The pitch information obtaining unit 620 transmits an extraction instruction including the search conditions to the pitch extraction device 1, and obtains a search result (information relating to encoded data that satisfies the search conditions) from the pitch extraction device 1.

The encoded data obtaining unit 630 obtains encoded data stored in the encoded data storage 510 of the storage device 5 in accordance with the search result obtained from the pitch extraction device 1.

The search result output unit 640 outputs the search result of the encoded data via the pitch extraction device 1 or information relating to the encoded data obtained by the encoded data obtaining unit 630.

Figure 12:
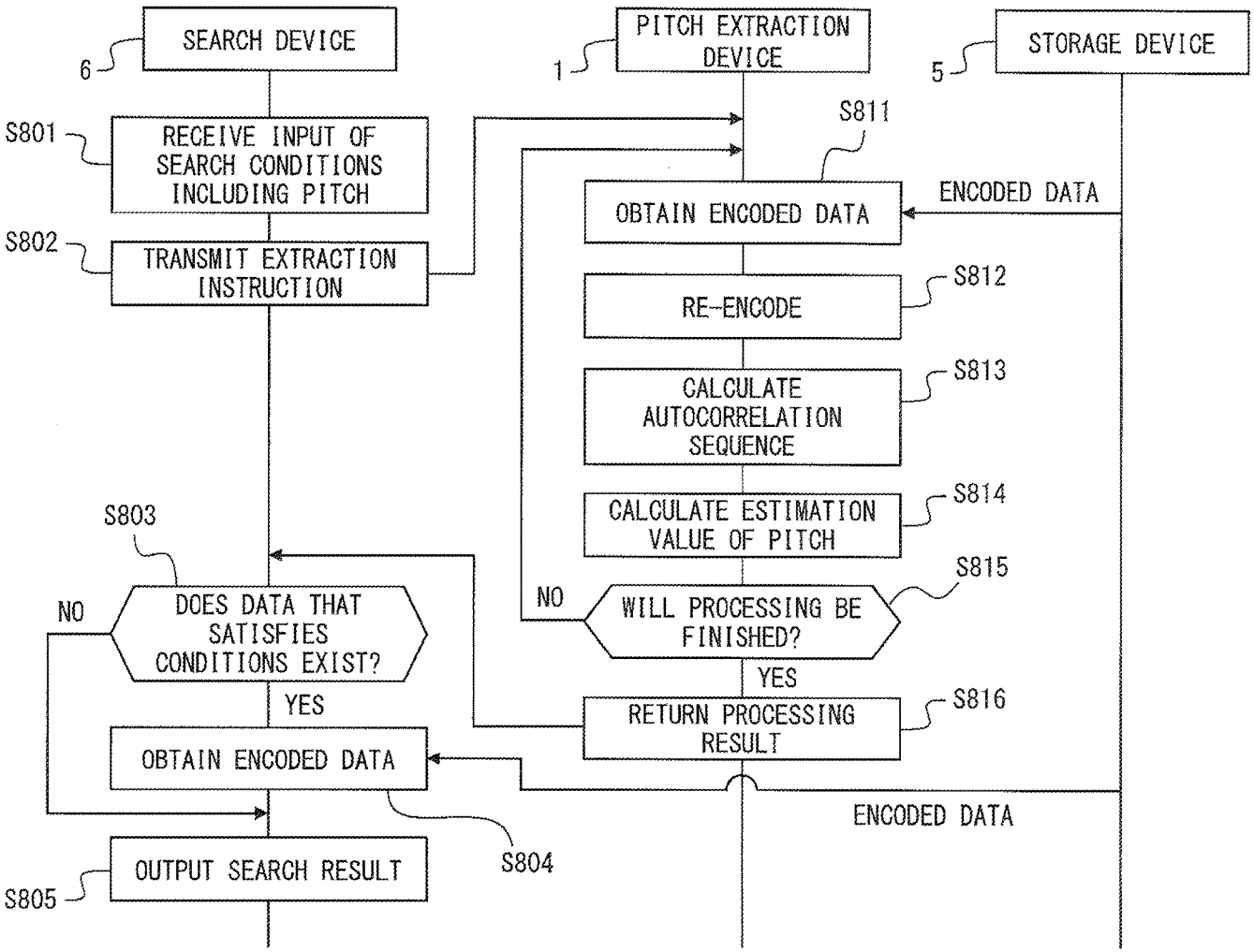
FIG. 12 is a sequence diagram explaining search processing of the search system according to the third embodiment.

FIG. 12 is a sequence diagram explaining search processing of the search system according to the third embodiment.

In searching for encoded data by using the search system 4 according to this embodiment, first, the search device 6 receives an input of search conditions including the pitch of desired encoded data (step S801), as illustrated in FIG. 12. The search conditions may include information that specifies encoded data to be searched for from among all pieces of encoded data stored in the encoded data storage 510 of the storage device 5 (for example, the date of the generation of the encoded data). Upon receipt of the input of the search conditions, the search device 6 transmits an extraction instruction including the search conditions to the pitch extraction device 1 (step S802). When the transmission process of step S802 is finished, the search device 6 is in a standby state until the search device 6 receives a processing result (an extraction result) from the pitch extraction device 1.

Upon receipt of the extraction instruction from the search device 6, the pitch extraction device 1 repeats the processes of steps S811 to S815.

The process of step S811 is a process for obtaining encoded data from the storage device 5. The process of step S811 is performed by the encoded data obtaining unit 110 in the pitch extraction device 1.

The process of step S812 is a process for re-encoding the obtained encoded data. The process of step S812 is performed by the re-encoder 120 in the pitch extraction device 1. The re-encoder 120 performs the processing described in the first embodiment (see FIG. 3) or the processing described in the second embodiment (see FIG. 9) so as to re-encode a bit stream (a first bit stream) of one frame in the encoded data into a second bit stream.

The process of step S813 is a process for calculating an autocorrelation sequence for the second bit stream. The process of step S813 is performed by the autocorrelation sequence calculator 130 in the pitch extraction device 1. The autocorrelation sequence calculator 130 calculates autocorrelation sequences Ri for N bit streams b(i) $\{i=0, 1, \ldots, N-1\}$ based on the second bit stream according to expression (1), as described in the first embodiment.

The process of step S814 is a process for calculating an estimation value of a pitch in accordance with the autocorrelation sequences Ri. The process of step S814 is performed by the pitch calculator 140 in the pitch extraction device 1. The pitch calculator 140 performs the processing described in the first embodiment (see FIG. 4) so as to calculate an estimation value of the pitch of a sound signal obtained by decoding the encoded data (the first bit stream).

The determination process of step S815 is a process for determining whether a prescribed piece of encoded data has been processed among all pieces of encoded data stored in the encoded data storage 510 of the storage device 5. The determination process of step S815 is performed, for example, by the encoded data obtaining unit 110 in the pitch extraction device 1. The encoded data obtaining unit 110 determines, for example, whether an estimation value of a pitch has been calculated for all pieces of encoded data specified in the search conditions received from the search device 6. When encoded data from which the estimation value of the pitch has not been calculated exists (step S815; NO), the encoded data obtaining unit 110 obtains the encoded data for which the estimation value of the pitch has not been calculated (step S811). When the estimation value of the pitch has been calculated for all pieces of encoded data to be processed (step S815; YES), the pitch extraction device 1 returns a processing result including the calculated estimation values of the pitches to the search device 6 (step S816). The process of step S816 is performed by the output unit 160. The output unit 160 returns, to the search device 6, a processing result that includes information, such as the file name of encoded data that satisfies the search conditions received from the search device 6 and an estimation value of a pitch for the encoded data. When encoded data that satisfies the search conditions does not exist in the encoded data storage 510 of the storage device 5, the output unit 160 returns, to the search device 6, a processing result that includes information indicating that no encoded data that satisfies the search conditions exists.

Upon receipt of the processing result from the pitch extraction device 1, the search device 6 determines whether encoded data that satisfies the search conditions exists in the encoded data storage 510 of the storage device 5 in accordance with the processing result (step S803). The determination process of step S803 is performed by the pitch information obtaining unit 620 in the search device 6. When the encoded data that satisfies the search conditions exists (step S803; YES), the search device 6 obtains the encoded data that satisfies the search conditions from the storage device 5 (step S804), and displays a search result (step S805). The process of step S804 is performed by the encoded data obtaining unit 630 in the search device 6. The process of step S805 is performed by the search result output unit 640. When no encoded data that satisfies the search conditions exists (step S03; NO), the search device 6 skips the process of step S804, and displays a search result (step S805).

As described above, after the search device 6 receives an input of search conditions including a pitch, the search system 4 according to this embodiment causes the pitch extraction device 1 to calculate an estimation value of the pitch of encoded data and to determine the presence/absence of encoded data that satisfies the search conditions. The search device 6 obtains the encoded data that satisfies the search conditions from the storage device 5 in accordance with a search result from the pitch extraction device 1. Namely, in the search system 4 according to this embodiment, the search device 6 does not need to perform a process for decoding encoded data and calculating a pitch or a process for calculating an estimation value of the pitch of the encoded data. Accordingly, in the search system 4 according to this embodiment, an operation amount and power consumption in the search device 6 can be reduced, and portable electronic equipment such as a smartphone can be used, for example, as the search device 6.

In addition, the pitch extraction device 1 calculates an estimation value of the pitch of a sound signal obtained by decoding encoded data in accordance with a second bit stream obtained by re-encoding the encoded data, as described in the first embodiment. Therefore, the pitch extraction device 1 can calculate an estimation value of the pitch of the encoded data in a short time. Accordingly, in the search system 4 according to this embodiment, a waiting time after an operator of the search device 6 performs an operation to start a search and before a search result is output can be reduced.

Further, in a case in which the search device 6 and the storage device 5 that stores encoded data are connected to each other via the network 7, as in the search system 4 of FIG. 10, the number of pieces of encoded data transmitted from the storage device 5 to the search device 6 can be reduced. Accordingly, an increase in traffic on the network 7 due to the transmission of encoded data from the storage device 5 to the search device 6 can be suppressed.

The search system 4 of FIG. 10 is an example of a search system to which the pitch extraction device 1 described in the first embodiment or the second embodiment is applied. The system configuration of the search system 4 according to this embodiment is not limited to the example illustrated in FIG. 10, and can be appropriately changed. As an example, the pitch extraction device 1 and the storage device 5 in the search system 4 may be incorporated into one server device instead of connecting individual devices via a prescribed cable. In addition, the pitch extraction device 1 may be incorporated into the search device 6. Further, the search system 4 may be, for example, a system including a plurality of storage devices 5.

<Fourth Embodiment>

In this embodiment, another example of the search device 6 in the search system 4 of FIG. 10 is described.

Figure 13:
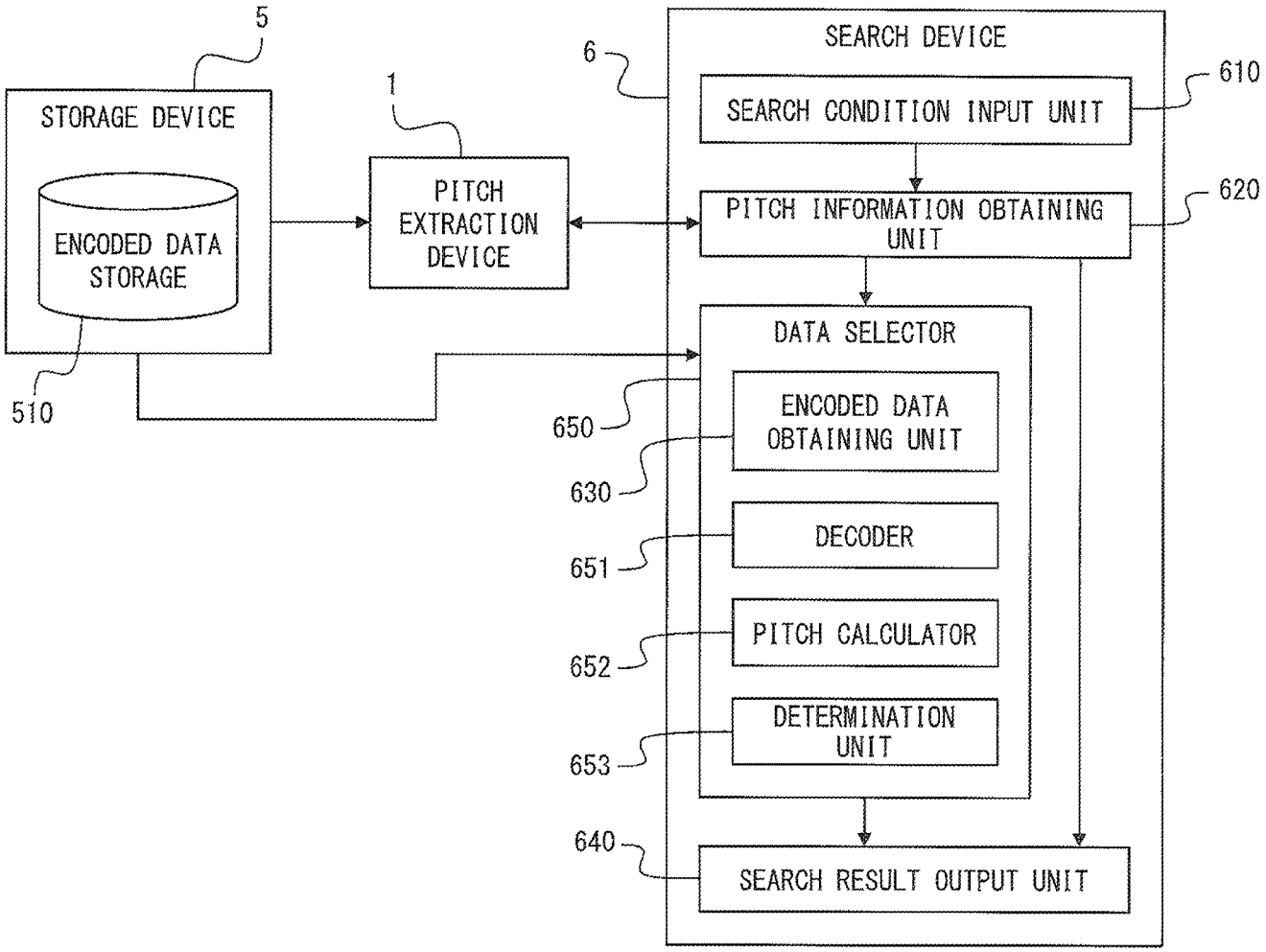
FIG. 13 illustrates a functional configuration of a search system according to a fourth embodiment.

FIG. 13 illustrates a functional configuration of a search system according to a fourth embodiment. In FIG. 13, a functional configuration of the pitch extraction device 1 is omitted.

As illustrated in FIG. 13, the search device 6 of the search system 4 according to this embodiment includes a search condition input unit 610, a pitch information obtaining unit 620, a data selector 650, and a search result output unit 640.

The search condition input unit 610, the pitch information obtaining unit 620, and the search result output unit 640 in the search device 6 according to this embodiment have the respective functions described in the third embodiment.

The data selector 650 in the search device 6 according to this embodiment selects encoded data in which the pitch of a decoded sound signal satisfies search conditions from among pieces of encoded data for which an estimation value of a pitch calculated by the pitch extraction device 1 satisfies the search conditions. The data selector 650 includes an encoded data obtaining unit 630, a decoder 651, a pitch calculator 652, and a determination unit 653.

The encoded data obtaining unit 630 obtains encoded data from the encoded data storage 510 of the storage device 5. The decoder 651 decodes the encoded data obtained from the storage device 5. The pitch calculator 652 calculates the pitch of the decoded data (a sound signal). The determination unit 653 determines whether the calculated pitch satisfies the condition of a pitch included in the search conditions.

The pitch extraction device 1 of the search system according to this embodiment includes an encoded data obtaining unit 110, a re-encoder 120, an autocorrelation sequence calculator 130, a pitch calculator 140, and an output unit 160 (see FIG. 11), but these are omitted in FIG. 13.

Figure 14:
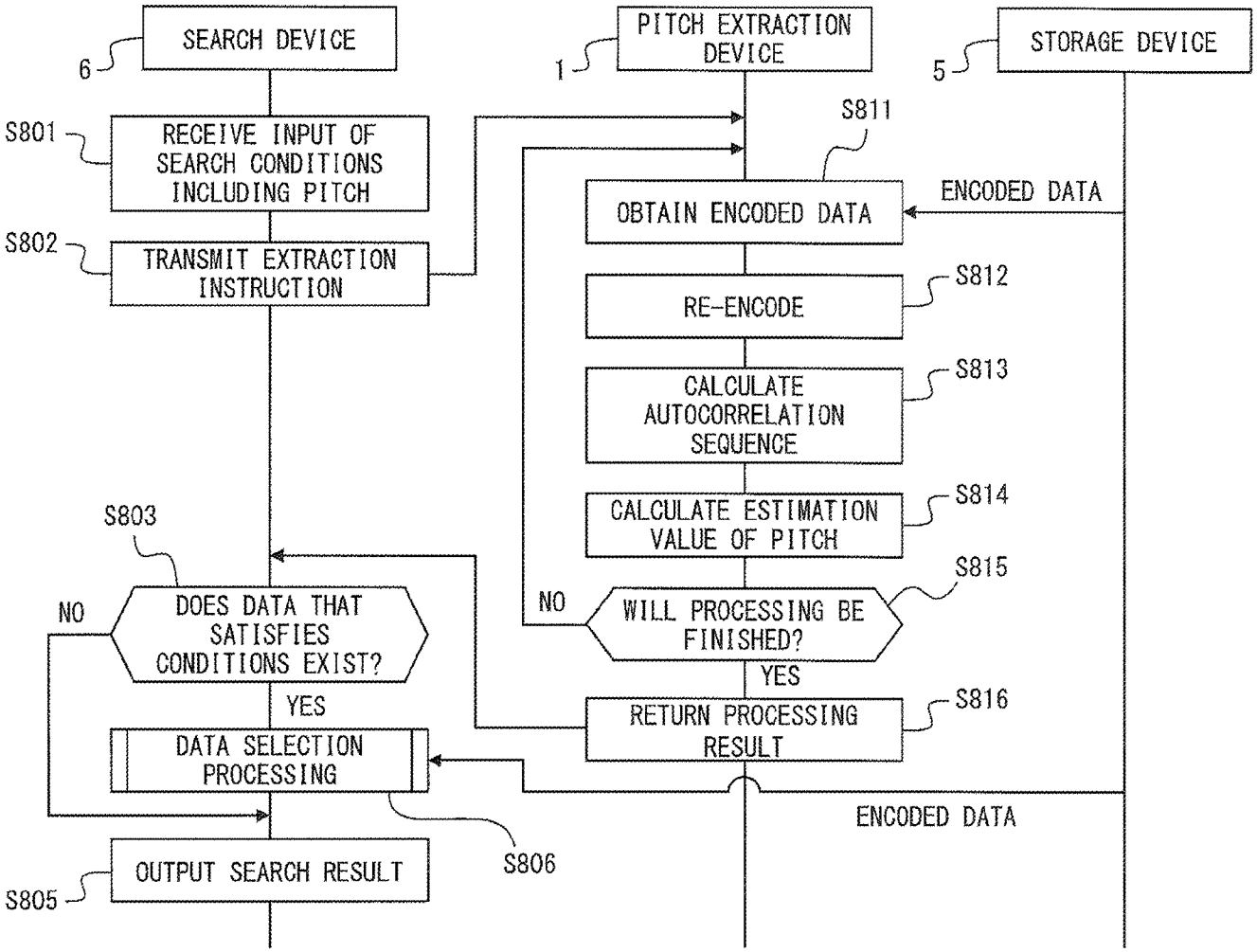
FIG. 14 is a sequence diagram explaining search processing of the search system according to the fourth embodiment.

FIG. 14 is a sequence diagram explaining search processing of the search system according to the fourth embodiment.

In searching for encoded data by using the search system 4 according to this embodiment, first, the search device 6 receives an input of search conditions including the pitch of a desired piece of encoded data (step S801), as illustrated in FIG. 14. The search conditions may include information that specifies encoded data to be searched for from among all pieces of encoded data stored in the encoded data storage 510 of the storage device 5 (for example, the date of the generation of the encoded data). Upon receipt of the input of the search conditions, the search device 6 transmits an extraction instruction including the search conditions to the pitch extraction device 1 (step S802). When the transmission process of step S802 is finished, the search device 6 is in a standby state until the search device 6 receives a processing result (an extraction result) from the pitch extraction device 1.

Upon receipt of the extraction instruction from the search device 6, the pitch extraction device 1 repeats the processes of step S811 to S815.

The process of step S811 is a process for obtaining encoded data from the storage device 5. The process of step S811 is performed by the encoded data obtaining unit 110 in the pitch extraction device 1.

The process of step S812 is a process for re-encoding the obtained encoded data. The process of step S812 is performed by the re-encoder 120 in the pitch extraction device 1. The re-encoder 120 performs the processing described in the first embodiment (see FIG. 3) or the processing described in the second embodiment (see FIG. 9) so as to re-encode the encoded data (a first bit stream) to a second bit stream.

The process of step S813 is a process for calculating an autocorrelation sequence for the second bit stream. The process of step S813 is performed by the autocorrelation sequence calculator 130 in the pitch extraction device 1. The autocorrelation sequence calculator 130 calculates autocorrelation sequences Ri for N bit streams b(i) {i=0, 1, . . . , N−1} based on the second bit stream according to expression (1), as described in the first embodiment.

The process of step S814 is a process for calculating an estimation value of a pitch in accordance with the autocorrelation sequences Ri. The process of step S814 is performed by the pitch calculator 140 in the pitch extraction device 1. The pitch calculator 140 performs the processing described in the first embodiment (see FIG. 4) so as to calculate an estimation value of the pitch of a sound signal obtained by decoding the decoded data (the first bit stream).

The determination process of step S815 is a process for determining whether a prescribed piece of encoded data has been processed among all pieces of encoded data stored in the encoded data storage 510 of the storage device 5. The determination process of step S815 is performed, for example, by the encoded data obtaining unit 110 in the pitch extraction device 1. The encoded data obtaining unit 110 determines, for example, whether an estimation value of a pitch has been calculated for all pieces of encoded data specified in the search conditions received from the search device 6. When encoded data for which the estimation value of the pitch has not been calculated exists (step S815; NO), the encoded data obtaining unit 110 obtained the encoded data for which the estimation value of the pitch has not been calculated (step S811). When the estimation value of the pitch has been calculated for all pieces of encoded data to be processed (step S815; YES), the pitch extraction device 1 returns, to the search device 6, a processing result including the calculated estimation values of the pitches (step S816). The process of step S816 is performed by the output unit 160. The output unit 160 returns, to the search device 6, a processing result that includes information, such as the file name of encoded data that satisfies the search conditions received from the search device 6 or an estimation value of the pitch of the encoded data. When no encoded data that satisfies the search conditions exists in the encoded data storage 510 of the storage device 5, the output unit 160 returns, to the search device 6, a processing result that includes information indicating that no encoded data that satisfies the search conditions exists.

Upon receipt of the processing result from the pitch extraction device 1, the search device 6 determines whether encoded data that satisfies the search conditions exists in accordance with the processing result (step S803). The determination result of step S803 is performed by the pitch information obtaining unit 620 in the search device 6. When the encoded data that satisfies the search conditions exists (step S803; YES), the search device 6 performs data selection processing for selecting the encoded data that satisfies the search conditions (step S806), and displays a search result (step S805). The process of step S806 is performed by the data selector 650 of the search device 6. The data selector 650 selects encoded data in which the pitch of a decoded sound signal satisfies the search conditions from among pieces of encoded data that satisfy the search conditions in the processing result of the pitch extraction device 1. The process of step S805 is performed by the search result output unit 640. When no encoded data that satisfies the search conditions exists (step S803; NO), the search device 6 skips the data selection processing of step S806, and displays a search result (step S805).

As described above, after the search device 6 receives an input of search conditions including a pitch, the search system 4 according to this embodiment causes the pitch extraction device 1 to calculate an estimation value of the pitch of encoded data and to determine the presence/absence of encoded data that satisfies the search conditions. The search device 6 selects encoded data in which the pitch of a decoded sound signal satisfies the search conditions from among pieces of encoded data that satisfy the search conditions in the processing result of the pitch extraction device 1. The data selection processing for selecting encoded data (step S806) is performed by the data selector 605 in the search device 6. The data selector 650 performs the processing illustrated in FIG. 15 as the data selection processing.

Figure 15:
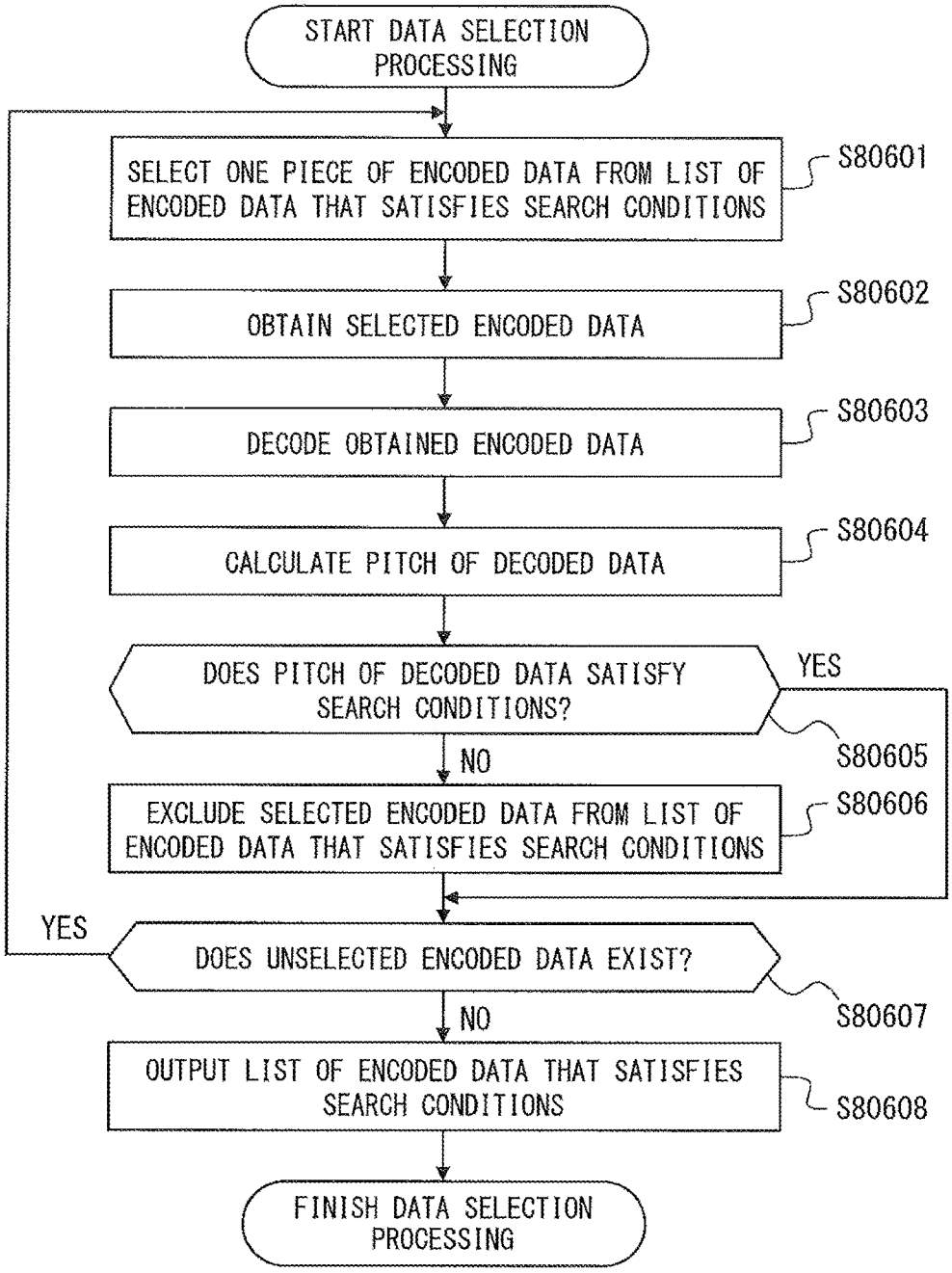
FIG. 15 is a flowchart explaining the content of data selection processing performed by a search device according to the fourth embodiment.

FIG. 15 is a flowchart explaining the content of the data selection processing performed by the search device according to the fourth embodiment.

In the data selection processing, the data selector 650 first selects one piece of encoded data from a list of encoded data that satisfies the search conditions (step S80601), and obtains the selected encoded data (step S80602). The processes of steps S80601 and S80602 are performed by the encoded data obtaining unit 630 in the data selector 650. In a list of encoded data that satisfies search conditions at the time when the data selection processing is started, the file name, a URL, and the like of encoded data for which an estimation value of a pitch calculated by the pitch extraction device 1 satisfies the search conditions are registered. The encoded data obtaining unit 630 selects encoded data from the list according to a prescribed selection rule, and obtains the selected encoded data from the storage device 5. Assume, for example, that the selection rule is that unselected encoded data that has the earliest registration order of the list.

The data selector 650 decodes the obtained encoded data (step S80603). The process of step S80603 is performed by the decoder 651. The decoder 651 decodes the encoded data according to a decoding method in an encoding standard of the obtained encoded data.

The data selector 650 calculates the pitch of the decoded data (step S80604). The process of step S80604 is performed by the pitch calculator 652. The pitch calculator 652 calculates the pitch of the decoded data (a sound signal) according to a known calculation method.

The data selector 650 determines whether the pitch of the decoded data satisfies the search conditions (step S80605). The determination of step S80605 is performed by the determination unit 653. When the pitch of the decoded data satisfies the search conditions (step S80605; YES), the determination unit 653 determines whether unselected encoded data exists in the list (step S80607).

When the pitch of the decoded data does not satisfy the search conditions (step S80605; NO), the determination unit 653 excludes the selected encoded data from the list of encoded data that satisfies the search conditions (step S80606). The determination unit 653 performs the determination of step S80607.

In step S80607, it is determined whether encoded data that has not been selected in step S80601 exists among pieces of encoded data registered in the list of encoded data that satisfies the search conditions. When unselected encoded data exists (step S80607; YES), the determination unit 653 causes the encoded data obtaining unit 630, the decoder 651, and the pitch calculator 652 to perform the processes of steps S80601 to S80606. When all pieces of encoded data registered in the list have been selected (step S80607; NO), the determination unit 653 outputs, to the search result output unit 640, the list of encoded data that satisfies the search conditions (step S80608). When the process of step S80608 is finished, the data selector 650 finishes the data selection processing.

As described above, in the search system 4 according to this embodiment, the search device 6 decodes encoded data for which an estimation value of a pitch calculated by the pitch extraction device 1 satisfies search conditions, and calculates the pitch of the decoded data. Stated another way, the search device 6 obtains only encoded data for which an estimation value of a pitch satisfies search conditions from among all pieces of encoded data stored in the encoded data storage 510 of the storage device 5, and calculates a pitch. In a method for calculating a pitch from data (a sound signal) obtained by decoding encoded data, the pitch can be calculated with a higher accuracy than the accuracy of the estimation value of the pitch calculated by the pitch extraction device 1. Therefore, in the search system 4 according to this embodiment, an operation amount in the search device 6 can be suppressed from increasing, and encoded data that satisfies search conditions can be extracted with a high accuracy and a high efficiency. In addition, arithmetic processing in the search device 6 can be suppressed from increasing, and therefore in the search system 4 according to this embodiment, portable electronic equipment such as a smartphone can be used, for example, as the search device 6.

In addition, the pitch extraction device 1 calculates an estimation value of the pitch of a sound signal obtained by decoding encoded data in accordance with the second bit stream obtained by re-encoding the encoded data, as described in the first embodiment. Therefore, the pitch extraction device 1 can calculate the estimation value of the pitch of the encoded data in a short time. Accordingly, in the search system 4 according to this embodiment, a waiting time after an operator of the search device 6 performs an operation to start a search and before a search result is output can be reduced.

Further, in a case in which the search device 6 and the storage device 5 that stores encoded data are connected to each other via the network 7, as in the search system 4 of FIG. 10, the number of pieces of encoded data transmitted from the storage device 5 to the search device 6 can be reduced. Accordingly, an increase in traffic on the network 7 due to the transmission of encoded data from the storage device 5 to the search device 6 can be suppressed.

The search system 4 according to this embodiment is not limited to the system configuration illustrated in FIG. 10, and may be appropriately changed, similarly to the search system 4 described in the third embodiment. As an example, the pitch extraction device 1 and the storage device 5 in the search system 4 may be incorporated into one server device instead of connecting individual devices via a prescribed cable. In addition, the pitch extraction device 1 may be incorporated into the search device 6. Further, the search system 4 may be, for example, a system including a plurality of storage devices 5.

In addition, the pitch extraction device 1 according to the respective embodiments above can be implemented by a computer and a program executed by the computer. A pitch extraction device 1 implemented by a computer and a program is described below with reference to FIG. 16.

Figure 16:
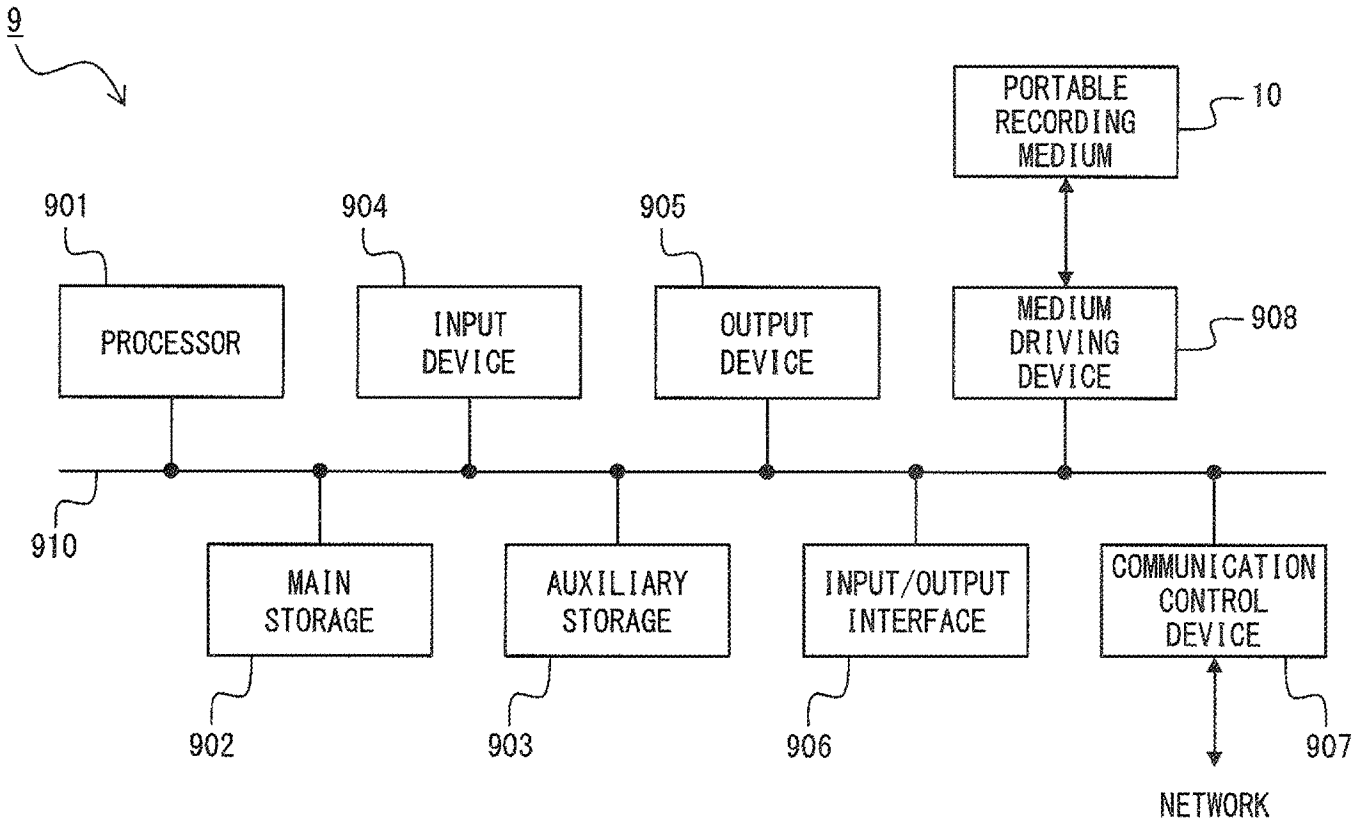
FIG. 16 illustrates a hardware configuration of a computer.

FIG. 16 illustrates a hardware configuration of a computer.

As illustrated in FIG. 16, a computer 9 includes a processor 901, a main storage 902, an auxiliary storage 903, an input device 904, an output device 905, an input/output interface 906, a communication control device 907, and a medium driving device 908. These components 901 to 908 in the computer 9 are connected to each other via a bus 910, and data can be communicated among these components.

The processor 901 is a central processing unit (CPU), a micro processing unit (MPU), or the like. The processor 901 controls the entire operation of the computer 9 by executing various programs including an operating system. In addition, the processor 901 executes a pitch extraction program including, for example, the processing illustrated in FIG. 2 to FIG. 4 for calculating an estimation value of a pitch or the processing illustrated in FIG. 2, FIG. 9, and FIG. 4 for calculating the estimation value of the pitch.

The main storage 902 includes a read-only memory (ROM) and a random access memory (RAM) that are not illustrated. In the ROM of the main storage 902, a prescribed basic control program or the like that is read by the processor 901 at the time of starting the computer 9 is registered, for example, in advance. The RAM of the main storage 902 is used as a working storage area as needed when various programs are executed. The RAM of the main storage 902 can be used as a storage (not illustrated) of the pitch extraction device 1 that stores, for example, obtained encoded data, a bit stream after re-encoding, a calculated autocorrelation sequence, a calculated estimation value of a pitch, and the like.

The auxiliary storage 903 is a storage that has a larger capacity than that of the RAM of the main storage 902, and the auxiliary storage 903 is, for example, a hard disk drive (HDD), a non-volatile memory (including a solid state drive (SSD)) such as a flash memory, or the like. The auxiliary storage 903 can be used to store various programs and various types of data that are executed by the processor 901. The auxiliary storage 903 can be used to store a pitch extraction program including, for example, the processing illustrated in FIG. 2 to FIG. 4 for calculating an estimation value of a pitch or the processing illustrated in FIG. 2, FIG. 9, and FIG. 4 for calculating the estimation value of the pitch. In addition, the auxiliary storage 903 can be used as a storage (not illustrated) of the pitch extraction device 1 that stores, for example, obtained encoded data, a bit stream after re-encoding, a calculated autocorrelation sequence, a calculated estimation value of a pitch, and the like.

The input device 904 is, for example, a keyboard device, a touch panel device, or the like. When an operator (a user) of the computer 9 performs a prescribed operation on the input device 904, the input device 904 transmits, to the processor 901, input information associated with the content of the operation. The input device 904 can be used, for example, to input search conditions including a value of a pitch and an instruction to start processing for calculating an estimation value of the pitch, and the like, to input an instruction relating to another process that can be performed by the computer 9, and the like, and to input various setting values.

The output device 905 is, for example, a display device such as a liquid crystal display device or a sound output device such as a receiver. The output device 905 can be used, for example, to display search conditions or a search result or to re-encode and recover encoded data.

The input/output interface 906 connects the computer 9 and other electronic equipment. The input/output interface 906 includes, for example, a connector of the universal serial bus (USB) standard. The input/output interface 906 can be used, for example, to connect the computer 9 and the storage device 5 (the external device 2).

The communication control device 907 is a device that connects the computer 9 to a network such as the Internet and controls various types of communication between the computer 9 and other communication equipment via the network. The communication control device 907 can be used, for example, for communication between the computer 9 and the search device 6.

The medium driving device 908 reads a program and data registered in a portable storage medium 10, or writes data or the like that has been stored in the auxiliary storage 903 to the portable storage medium 10. As the medium driving device 908, a reader/writer for a memory card that conforms to one or more standards can be used, for example. In a case in which the reader/writer for the memory card is used as the medium driving device 908, a memory card (a flash memory) of a standard that the reader/writer for the memory card conforms to, such as the secure digital (SD) standard, can be used, for example, as the portable storage medium 10. In addition, a flash memory including a connector of the USB standard can be used, for example, as the portable recording medium 10. Further, in a case in which the computer 9 mounts an optical disk drive that can be used as the medium driving device 908, various optical disks that can be recognized by the optical disk drive can be used as the portable recording medium 10. Examples of the optical disk that can be used as the portable recording medium 10 include a compact disc (CD), a digital versatile disc (DVD), and a Blu-ray disc (Blu-ray is a registered trademark). The portable recording medium 10 can be used to store a pitch extraction program including, for example, the processing illustrated in FIG. 2 to FIG. 4 for calculating an estimation value of a pitch or the processing illustrated in FIG. 2, FIG. 9, and FIG. 4 for calculating the estimation value of the pitch. In addition, the auxiliary storage 903 can be used as a storage (not illustrated) of the pitch extraction device 1 that stores, for example, obtained encoded data, a bit stream after re-encoding, a calculated autocorrelation sequence, a calculated estimation value of a pitch, and the like.

As an example, when an operator inputs an instruction to start processing for calculating an estimation value of a pitch by using the input device 904 or the like, the processor 901 reads and executes a pitch extraction program stored in a non-transitory recording medium such as the auxiliary storage 903. In this process, the processor 901 functions (operates) as the encoded data obtaining unit 110, the re-encoder 120, the autocorrelation sequence calculator 130, the pitch calculator 140, and the output unit 150 in the pitch extraction device 1. While the processor 901 is executing the pitch extraction program, the RAM of the main storage 902, the auxiliary storage 903, or the like functions as a storage of the pitch extraction device 1 that stores obtained encoded data, a bit stream after re-encoding, a calculated estimation value of a pitch, and the like.

The computer 9 that is made to operate as the pitch extraction device 1 does not need all of the components 901 to 908 illustrated in FIG. 16, and some components can be omitted according to usage or conditions. As an example, the communication control device 907 and the medium driving device 908 may be omitted from the computer 9.

In a case in which the computer 9 is made to operate as the pitch extraction device 1, the auxiliary storage 903 or the portable recording medium 10 can be used, for example, as the encoded data storage 510 of the storage device 5.

Further, the computer 9 can be made to operate as the search device 6 in the search system 4 in addition to the pitch extraction device 1.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A pitch extraction device comprising:

a memory; and a processor coupled to the memory, and configured to perform a process including:

dividing a first bit stream in encoded data into a plurality of sections each having a prescribed section length, the encoded data being obtained by performing entropy encoding on a residual signal calculated by performing linear prediction analysis on a sound signal, the first bit stream including two types of the bit values, 0 and 1;

allocating a first value or a second value to each of the plurality of sections in the first bit stream in accordance with a bit value in each of the plurality of sections, the first value being allocated to the sections in which a number of 0's is greater than or equal to a threshold from among the plurality of sections in the first bit stream, the second value being allocated to the other sections;

generating a second bit stream obtained by re-encoding the first bit stream according to the first value and the second value that have been allocated to each of the plurality of sections in the first bit stream;

calculating an estimation value of a fundamental frequency of the sound signal in accordance with an autocorrelation of the second bit stream; and outputting the estimation value as the fundamental frequency of the sound signal.

2. The pitch extraction device according to claim 1, the process further comprising:

calculating an autocorrelation sequence for the second bit stream in accordance with the second bit stream and a third bit stream obtained by shifting the second bit stream, wherein the processor calculates the fundamental frequency of the sound signal in accordance with a position of a maximal value in the calculated autocorrelation sequence.

3. The pitch extraction device according to claim 2, wherein the first value allocated to the section in the first bit stream is specified as 1, and the second value is specified as 0, and the processor calculates an AND of values at a same digit in the second bit stream and the third bit stream, and calculates the autocorrelation sequence in accordance with a number of digits at which the AND is 1.

4. The pitch extraction device according to claim 2, wherein the processor compares values at a same digit in the second bit stream and the third bit stream, and calculates the autocorrelation sequence in accordance with a number of digits at which the values are different from each other.

5. The pitch extraction device according to claim 2, wherein the processor calculates the fundamental frequency of the sound signal in accordance with the position of the maximal value that exceeds a threshold from among the maximal values in the autocorrelation sequence.

6. The pitch extraction device according to claim 2, wherein the processor smooths the autocorrelation sequence, and calculates the fundamental frequency of the sound signal in accordance with the position of the maximal value in the smoothed autocorrelation sequence.

7. The pitch extraction device according to claim 1, wherein the processor allocates the first value to the sections in which all of the bit values are 0 from among the plurality of sections in the first bit stream, and allocates the second value to the other sections.

8. The pitch extraction device according to claim 1, wherein the processor allocates the first value to the sections in which at least one of the bit values are 0 from among the plurality of sections in the first bit stream, and allocates the second value to the sections in which all of the bit values are 1 from among the plurality of sections in the first bit stream.

9. The pitch extraction device according to claim 1, wherein the processor divides the first bit stream in the encoded data into the plurality of sections, the encoded data being obtained by performing entropy encoding on the residual signal by using one of unary encoding, gamma encoding, delta encoding, Golomb-Rice encoding, and Huffman encoding.

10. A pitch extraction method comprising:

dividing, by a computer, a first bit stream in encoded data into a plurality of sections each having a prescribed section length, the encoded data being obtained by performing entropy encoding on a residual signal calculated by performing linear prediction analysis on a sound signal, the first bit stream including two types of the bit values, 0 and 1;

allocating, by the computer, a first value or a second value to each of the plurality of sections in the first bit stream in accordance with a bit value in each of the plurality of sections, the first value being allocated to the sections in which a number of 0's is greater than or equal to a threshold from among the plurality of sections in the first bit stream, the second value being allocated to the other sections;

generating, by the computer, a second bit stream obtained by re-encoding the first bit stream according to the first value and the second value that have been allocated to each of the plurality of sections in the first bit stream;

calculating, by the computer, an autocorrelation sequence for the second bit stream;

calculating, by the computer, an estimation value of a fundamental frequency of the sound signal in accordance with the autocorrelation sequence of the second bit stream; and outputting, by the computer, the estimation value as the fundamental frequency of the sound signal.

11. The pitch extraction method according to claim 10, wherein the calculating the autocorrelation sequence calculates the autocorrelation sequence in accordance with the second bit stream and a third bit stream obtained by shifting the second bit stream, and the calculating the fundamental frequency of the sound signal calculates the fundamental frequency in accordance with a position of a maximal value in the calculated autocorrelation sequence.

12. The pitch extraction method according to claim 11, wherein the calculating the fundamental frequency of the sound signal calculates the fundamental frequency of the sound signal in accordance with the position of the maximal value that exceeds a threshold from among the maximal values in the autocorrelation sequence.

13. The pitch extraction method according to claim 11, wherein the calculating the fundamental frequency of the sound signal smooths the autocorrelation sequence, and calculates the fundamental frequency of the sound signal in accordance with the position of the maximal value in the smoothed autocorrelation sequence.

14. The pitch extraction method according to claim 10, wherein the dividing the first bit stream into the plurality of sections divides the first bit stream in the encoded data into the plurality of sections, the encoded data being obtained by performing entropy encoding on the residual signal by using one of unary encoding, gamma encoding, delta encoding, Golomb-Rice encoding, and Huffman encoding.

* * * * *